US009158221B2

(12) United States Patent
Sato

(10) Patent No.: US 9,158,221 B2
(45) Date of Patent: Oct. 13, 2015

(54) REMOVABLE WASTE TONER STORAGE CONFIGURATION FOR AN IMAGE FORMING APPARATUS

(71) Applicant: Shougo Sato, Seto (JP)

(72) Inventor: Shougo Sato, Seto (JP)

(73) Assignee: Brother Kogyo Kabushiki Kaisha, Nogoya-shi, Aichi-ken (JP)

( * ) Notice: Subject to any disclaimer, the term of this patent is extended or adjusted under 35 U.S.C. 154(b) by 0 days.

(21) Appl. No.: 14/141,453

(22) Filed: Dec. 27, 2013

(65) Prior Publication Data

US 2014/0186071 A1 Jul. 3, 2014

(30) Foreign Application Priority Data

Dec. 27, 2012 (JP) ..... 2012-285874
Dec. 27, 2012 (JP) ..... 2012-285905
Dec. 27, 2012 (JP) ..... 2012-285932

(51) Int. Cl.
*G03G 15/01* (2006.01)
*G03G 21/10* (2006.01)
*G03G 21/16* (2006.01)
(Continued)

(52) U.S. Cl.
CPC ..... *G03G 15/0194* (2013.01); *G03G 15/161* (2013.01); *G03G 21/105* (2013.01); *G03G 21/12* (2013.01); *G03G 2215/0148* (2013.01)

(58) Field of Classification Search
CPC ..... G03G 21/18; G03G 21/105; G03G 21/10; G03G 21/1619; G03G 15/161; G03G 2215/1647; G03G 2221/1603; G03G 15/0194
USPC ..... 399/110, 112, 121, 123, 358, 98, 101
See application file for complete search history.

(56) References Cited

U.S. PATENT DOCUMENTS 5,614,997 A * 3/1997 Marumoto ..... 399/121
6,801,742 B1 10/2004 Mochimaru et al.
7,899,355 B2 3/2011 Sakuma
(Continued)

FOREIGN PATENT DOCUMENTS

JP 11-038711 A 2/1999
JP 2003-287939 A 10/2003
(Continued)

OTHER PUBLICATIONS

Machine translation of JP 2010-008472 (with publication date of Jan. 14, 2010), printed on Jan. 30, 2015.*

*Primary Examiner* — Sophia S Chen
(74) *Attorney, Agent, or Firm* — Banner & Witcoff, Ltd.

(57) ABSTRACT

An image forming apparatus includes: a casing; a belt unit including a first roller, a second roller positioned higher than the first roller and a belt; image bearing members; developer containers; a removing member; an accommodating member; and a conveying member. The image bearing members includes a first image bearing member and a second image bearing member. The removing member is positioned adjacent to the second image bearing member and below an imaginary plane. The accommodating member accommodates the waste toner removed by the removing member, and is positioned adjacent to the first image bearing member and above the imaginary plane. The accommodating member is mounted in and removed from the casing along with a first developer container corresponding to the first image bearing member. The conveying member conveys the waste toner removed by the removing member to the accommodating member.

13 Claims, 18 Drawing Sheets

(51) Int. Cl.
*G03G 15/16* (2006.01)
*G03G 21/12* (2006.01)

(56) References Cited

U.S. PATENT DOCUMENTS

| | | | | |
|---|---|---|---|---|
| 8,270,869 | B2 | 9/2012 | Sakuma | |
| 8,457,518 | B1 | 6/2013 | Sakuma | |
| 8,532,521 | B2 | 9/2013 | Sakuma | |
| 2006/0140669 | A1* | 6/2006 | Sato | 399/110 |
| 2009/0285593 | A1 | 11/2009 | Sakuma | |
| 2010/0028041 | A1 | 2/2010 | Sakuma | |
| 2010/0074646 | A1 | 3/2010 | Miyahara et al. | |
| 2012/0014729 | A1 | 1/2012 | Sakuma | |
| 2012/0195622 | A1* | 8/2012 | Shimizu et al. | 399/98 |
| 2012/0328348 | A1 | 12/2012 | Sakuma | |
| 2013/0121728 | A1 | 5/2013 | Sakuma | |
| 2013/0308976 | A1* | 11/2013 | Sekido | 399/110 |
| 2014/0119772 | A1* | 5/2014 | Sato | 399/110 |

FOREIGN PATENT DOCUMENTS

| | | | |
|---|---|---|---|
| JP | 2005-145667 | A | 6/2005 |
| JP | 2006-163192 | A | 6/2006 |
| JP | 2006-232467 | A | 9/2006 |
| JP | 2008-170510 | A | 7/2008 |
| JP | 2009-276438 | A | 11/2009 |
| JP | 2010-008472 | A | 1/2010 |
| JP | 2010-038947 | A | 2/2010 |
| JP | 2010-164633 | A | 7/2010 |

* cited by examiner

REMOVABLE WASTE TONER STORAGE CONFIGURATION FOR AN IMAGE FORMING APPARATUS

CROSS REFERENCE TO RELATED APPLICATION

This application claims priority from Japanese Patent Application Nos. 2012-285874 filed Dec. 27, 2012, 2012-285905 filed Dec. 27, 2012, and 2012-285932 filed Dec. 27, 2012. The entire content of each of the priority applications is incorporated herein by reference.

TECHNICAL FIELD

The present invention relates to an image forming apparatus employing an electrophotographic system.

BACKGROUND

One electrophotographic image forming apparatus known in the art (hereinafter referred to as a first conventional image forming apparatus) includes a plurality of photosensitive members on which electrostatic latent images are formed. One such image forming apparatus known in the art includes four process cartridges and an image-forming unit to support the process cartridges. The process cartridges are provided for each of four colors used in the image forming apparatus and each include a photosensitive drum. In this image forming apparatus, a waste toner box serving to accommodate waste toner therein is provided in the image-forming unit at a leading end portion (i.e. downstream end portion) thereof in a direction in which the image-forming unit is pulled out of the apparatus. This conventional image forming apparatus also includes a belt-waste-toner conveying tube for conveying waste toner from a belt-cleaning device to the waste toner box.

Further, one electrophotographic image forming apparatus known in the art (hereinafter referred to as a second conventional image forming apparatus) is a printer including a device body that accommodates a sheet-feeding unit for supplying sheets of paper, and an image-forming unit for forming images on the sheets supplied by the sheet-feeding unit. The image-forming unit further includes a plurality of process cartridges arranged at intervals in a front-rear direction and respectively supporting photosensitive drums, and a transfer unit for transferring toner images formed on the photosensitive drums onto the sheets supplied from the sheet-feeding unit. One such color printer that has been proposed provides the sheet-feeding unit with conveying rollers for supplying the sheets to the image-forming unit, and provides the transfer unit with a conveying belt positioned in confrontation with the plurality of photosensitive drums for conveying the sheets. In this conventional color printer, the conveying rollers are disposed apart from and obliquely above and forward of the transfer unit so as to overlap the transfer unit when projected in the front-rear direction.

Further, one electrophotographic image forming apparatus known in the art (hereinafter referred to as a third conventional image forming apparatus) includes a plurality of photosensitive members on which electrostatic latent images are formed, and a plurality of developing units that supply developer to corresponding photosensitive members. One such image forming apparatus has a plurality of process cartridges corresponding to colors used in the image forming apparatus. Each process cartridge includes a photosensitive drum, a developing roller disposed on the upper rear side of the photosensitive drum, and a supply roller disposed on the upper rear side of the developing roller. The space in the process cartridge above the developing roller and the supply roller serves as a toner-accommodating chamber for accommodating toner.

SUMMARY

In the first conventional image forming apparatus described above, maintenance is performed separately on the waste toner box and the process cartridges. Here, there has been a proposal to provide the waste toner box integrally with one of the process cartridges so that maintenance could be performed on the waste toner box at the same time maintenance is performed on the process cartridge.

However, when the waste toner box is provided integrally with the process cartridge, the waste toner box is separated vertically from the belt-cleaning device, making it difficult to convey toner upward toward the waste toner box. A particular problem with this structure is that more image forming apparatus in recent years are employing spherical toner particles having excellent fluidity, such as polymer toner, in an effort to improve image quality. However, spherical toner has a low angle of repose and, thus, is difficult to convey upward.

In view of the foregoing, it is an object of the present invention to provide an image forming apparatus including an accommodating member that is mounted in and removed from the image forming apparatus integrally with a developer container and that can facilitate conveyance of deposited matter removed by a removing member to the accommodating member.

With the second conventional image forming apparatus described above, it is sometimes necessary to remove the transfer unit from the device body in order to perform maintenance on the transfer unit, such as replacing the conveying belt. However, since the conveying rollers in the sheet-feeding unit overlap the transfer unit when projected in the front-rear direction, the conveying rollers obstruct the transfer unit when the transfer unit is pulled forward out of the device body. Consequently, operations for mounting and removing the transfer unit relative to the device body are made more complex, making maintenance operation on the transfer unit complex.

In view of the foregoing, it is another object of the present invention to provide an image forming apparatus capable of facilitating smooth operations for mounting and removing a belt unit relative to a casing and thereby capable of facilitating maintenance operations on the belt unit.

In the third conventional image forming apparatus described above, toner supplied onto the developing roller tends to accumulate by its own weight near the region of contact between the developing roller and the supply roller. Consequently, the toner applies pressure to a thickness-regulating blade, sealing portions, and other members provided around the developing roller and can compromise the seal around the developing roller. If the periphery of the developing roller is insufficiently sealed, toner may leak out around the developing roller.

In view of the foregoing, it is still another object of the present invention to provide an image forming apparatus capable of restraining developer from leaking out around a developer carrying member.

In order to attain the above and other objects, the present invention provides an image forming apparatus including: a casing; a belt unit; a plurality of image bearing members; a plurality of developer containers; a removing member; an accommodating member; and a conveying member. The belt unit is configured to be accommodated in the casing. The belt unit including: a first roller; a second roller; and a belt. The first roller has a first rotation axis. The second roller has a second rotation axis parallel to the first rotation axis. The second roller is disposed spaced apart from the first roller and positioned higher than the first roller. The belt is looped around the first roller and the second roller and has an upper portion. The plurality of image bearing members is each configured to bear a developer image thereon. The plurality of image bearing members is arranged juxtaposed with each other and spaced apart from each other in an orthogonal direction that is orthogonal to the first and second rotation axes and that is oriented in a direction from the first roller to the second roller. The plurality of image bearing members each has a bottom portion contacting the upper portion of the belt. The plurality of image bearing members includes a first image bearing member positioned closer to the first roller than remaining image bearing members to the first roller and a second image bearing member positioned closer to the second roller than remaining image bearing members to the second roller. The plurality of developer containers is disposed in one-to-one correspondence with the plurality of image bearing members. The plurality of developer containers is each configured to accommodate developer therein and configured to be detached from and attached to the casing. The plurality of developer containers includes a first developer container corresponding to the first image bearing member. The removing member is configured to remove a waste toner deposited on the belt. The removing member is positioned adjacent to the second image bearing member and below an imaginary plane containing a top surface of the upper portion of the belt. The accommodating member is configured to accommodate the waste toner removed by the removing member. The accommodating member is positioned adjacent to the first image bearing member and above the imaginary plane. The accommodating member is configured to be mounted in and removed from the casing along with the first developer container. The conveying member is configured to convey the waste toner removed by the removing member to the accommodating member.

Specifically, in the first embodiment, the first roller corresponds to a drive roller and the second roller corresponds to a follow roller, and in the second embodiment, the first roller corresponds to a follow roller and the second roller corresponds to a drive roller. Further, in the first embodiment, the first image bearing member corresponds to a rearmost image bearing member and the second image bearing member corresponds to a frontmost image bearing member, and in the second embodiment, the first image bearing member corresponds to a frontmost image bearing member and the second image bearing member corresponds to a rearmost image bearing member. Further, in the first embodiment, the orthogonal direction corresponds to a direction from a lower rear side to an upper front side of a casing, and in the second embodiment, the orthogonal direction corresponds to a direction from a lower front side to an upper rear side of a casing.

According to another aspect, the present invention provides an image forming apparatus including: a casing; a plurality of photosensitive members; and a belt unit. The plurality of photosensitive members is arranged juxtaposed with each other in the casing in a juxtaposed direction and is each configured to transfer a developer image on a recording medium. The belt unit includes: a belt confronting the plurality of photosensitive members; and a pair of conveying rollers configured to convey a recording medium to a position between the plurality of photosensitive members and the belt. The pair of conveying rollers is disposed in proximity to each other. The belt unit is configured to move relative to the casing between a mounted position in which the belt unit is mounted in the casing and a removed position in which the belt unit is removed from the casing.

According to still another aspect, the present invention provides an image forming apparatus including: a casing; a belt unit; a plurality of image bearing members; a plurality of developer carrying members; and a plurality of supply members. The belt unit is configured to be accommodated in the casing. The belt unit including: a first roller; a second roller; and a belt. The first roller has a first rotation axis. The second roller has a second rotation axis parallel to the first rotation axis. The second roller is disposed spaced apart from the first roller and positioned higher than the first roller. The belt is looped around the first roller and the second roller, and has an upper portion. The plurality of image bearing members is each configured to bear an electrostatic latent image thereon. The plurality of image bearing members is arranged juxtaposed with each other and spaced apart from each other in an orthogonal direction that is orthogonal to the first and second rotation axes and that is oriented in a direction from the first roller to the second roller. The plurality of image bearing members each has a bottom portion contacting the upper portion of the belt. The plurality of image bearing members each has a third rotation axis and is each configured to rotate about the third rotation axis. The plurality of developer carrying members is disposed in one-to-one correspondence with the plurality of image bearing members. The plurality of developer carrying members is each configured to carry developer thereon and each contacts the corresponding image bearing member. The plurality of developer carrying members each has a fourth rotation axis parallel to the third rotation axis and is each configured to rotate about the fourth rotation axis. The fourth rotation axis is positioned upstream of the third rotation axis in the orthogonal direction. The plurality of supply members is disposed in one-to one correspondence with the plurality of developer carrying members. The plurality of supply members is each configured to supply developer to the corresponding developer carrying member and each contacts the corresponding developer carrying member. The plurality of supply members each has a fifth rotation axis parallel to the third rotation axis and is each configured to rotate about the fifth rotation axis. The fifth rotation axis is positioned upstream of the fourth rotation axis in the orthogonal direction and positioned lower than the fourth rotation axis.

DETAILED DESCRIPTION

1. Overall Structure of Printer

Next, an overall structure of a printer as an image forming apparatus according to a first embodiment of the present invention will be described with reference to FIGS. 1 to 8.

Figure 1:
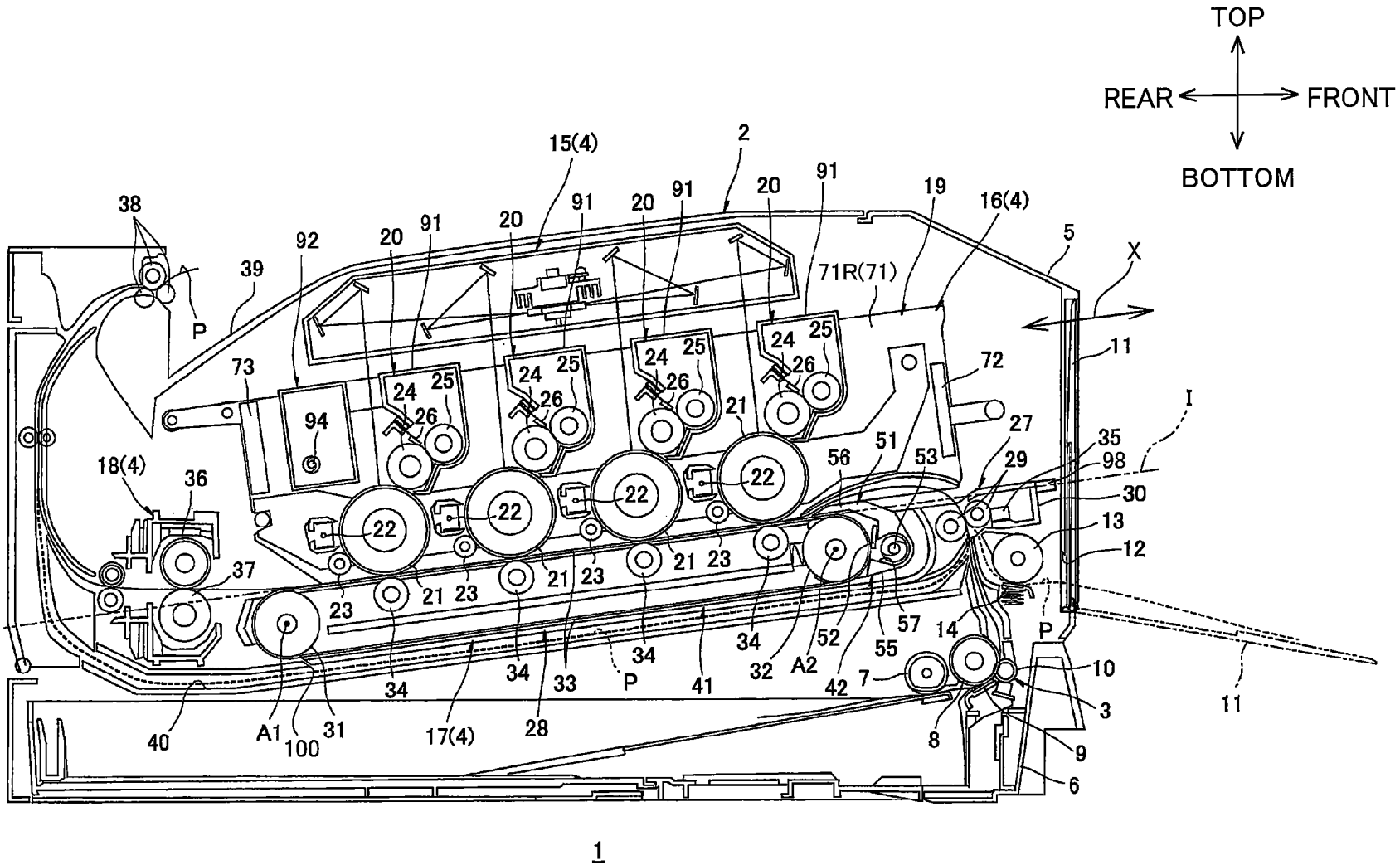
FIG. 1 is a schematic center cross-sectional view of a printer according to a first embodiment of the present invention.

As shown in FIG. 1, the printer 1 is a horizontal direct tandem-type color laser printer. The printer 1 has a main casing 2. The main casing 2 is box-shaped and generally rectangular in a side view.

In the following description, the terms "upward", "downward", "upper", "lower", "above", "below", "beneath", "right", "left", "front", "rear" and the like will be used assuming that the printer 1 is disposed in an orientation in which it is intended to be used. That is, directions related to the printer 1 will be given based on the state of the printer 1 when the printer 1 is resting on a level surface. More specifically, in FIG. 1, a right side and a left side are a front side and a rear side, respectively. Further, a left side and a right side of the printer 1 will be based on the perspective of a user facing the front of the printer 1. Hence, in FIG. 1, a near side and a far side are a left side and a right side, respectively.

A front cover 5 is provided on a front side of the main casing 2. The front cover 5 can be opened in order to mount or remove a process unit 16 described later. Within the main casing 2, the printer 1 is provided with a sheet-feeding unit 3 for feeding sheets P of paper to be printed, and an image-forming unit 4 for forming images on the sheets P fed by the sheet-feeding unit 3.

(1) Sheet-Feeding Unit

The sheet-feeding unit 3 includes a paper tray 6 that accommodates the sheets P therein. The paper tray 6 is detachably mounted in a bottom section of the main casing 2.

The sheet-feeding unit 3 also includes a pickup roller 7 disposed above a front end portion of the paper tray 6, a feeding roller 8 disposed forward of the pickup roller 7, a feeding pad 9 disposed below and in confrontation with the feeding roller 8, and a guide roller 10 disposed in contact with a front portion of the feeding roller 8.

As indicated by a solid line in FIG. 1, the pickup roller 7 rotates to convey the sheets P from the paper tray 6 to a position between the feeding roller 8 and the feeding pad 9, and the rotation of the feeding roller 8 separates and feeds the sheets P one at a time. As the feeding roller 8 continues to rotate, each separated sheet P subsequently passes between the feeding roller 8 and the guide roller 10 and is supplied toward a pair of registration rollers 29 described later. The sheet-feeding unit 3 defines a path, serving as a first sheet conveying path, for conveying the sheets P from the paper tray 6 to the pair of registration rollers 29.

The sheet-feeding unit 3 also includes a manual-feed tray 11 provided at the front cover 5. The manual-feed tray 11 is pivotally movable to open and close a manual-feed insertion opening 12 formed in the front cover 5. The manual-feed tray 11 in the open state is delineated by a two-dotted dashed line in FIG. 1. As indicated by a narrow dashed line in FIG. 1, the sheet-feeding unit 3 also defines a manual-feed path, serving as a second sheet conveying path, for conveying the sheets P from the manual-feed tray 11 to the pair of registration rollers 29.

The sheet-feeding unit 3 also includes a manual-feed roller 13 disposed in confrontation with and on the rear side of the manual-feed insertion opening 12, and a manual-feed pad 14 disposed in confrontation with and below the manual-feed roller 13. When the sheets P are placed on the manual-feed tray 11, leading edges of the sheets P are inserted through the manual-feed insertion opening 12 to confront a contacting part of the manual-feed roller 13 and the manual-feed pad 14.

By rotating, the manual-feed roller 13 separates and feeds the sheets P resting on the manual-feed tray 11 one at a time toward the pair of registration rollers 29 described later.

(2) Image-Forming Unit

The image-forming unit 4 includes a scanning unit 15, the process unit 16, a transfer unit 17, and a fixing unit 18.

(2-1) Scanning Unit

The scanning unit 15 is disposed in a top section of the main casing 2. The scanning unit 15 is adapted to emit laser beams toward respective photosensitive drums 21 (described later) based on image data, thereby exposing the photosensitive drums 21. The paths of the laser beams are depicted using solid lines in FIG. 1.

(2-2) Process Unit

The process unit 16 is disposed beneath the scanning unit 15 and above the transfer unit 17. The process unit 16 is inclined relative to the horizontal so that its front end is positioned higher than its rear end. The process unit 16 includes a process frame 19 and a plurality of developer cartridges 20 (four in the embodiment) corresponding to the four colors used in image formation.

The process frame 19 is movable relative to the main casing 2 in a juxtaposed direction X (described later) between an accommodated position (see FIG. 1) and a withdrawn position (see FIG. 7). In the accommodated position, the process frame 19 is accommodated inside the main casing 2. In the withdrawn position, the process frame 19 is withdrawn to an outside of the main casing 2. The process frame 19 can be removed from the main casing 2 in the withdrawn position.

The process frame 19 retains a plurality of photosensitive drums 21 (four in the embodiment), a plurality of scorotron chargers 22 (four in the embodiment), and a plurality of drum-cleaning rollers 23 (four in the embodiment).

The plurality of photosensitive drums 21 is disposed along a direction sloping downward toward the rear, that is, along the inclination of the process unit 16. More specifically, the plurality of photosensitive drums 21 is arranged juxtaposed with each other and spaced at intervals along the juxtaposed direction X. The juxtaposed direction X includes a direction sloping downward toward the rear and a direction sloping upward toward the front. The plurality of photosensitive drums 21 is provided for the four colors of cyan, magenta, yellow, and black and is arranged at intervals in this order from the lower rear side to the upper front side of the main casing 2. Each photosensitive drum 21 is generally cylindrical in shape and oriented with its axis in a left-right direction. That is, each photosensitive drum 21 is elongated in the left-right direction.

The plurality of scorotron chargers 22 is provided in one-to-one correspondence with the plurality of photosensitive drums 21. Each scorotron charger 22 is positioned on the rear side of the corresponding photosensitive drum 21, and also positioned to confront but not contact the corresponding photosensitive drum 21.

The plurality of drum-cleaning rollers 23 is provided in one-to-one correspondence with the plurality of photosensitive drums 21. Each drum-cleaning roller 23 is positioned so as to contact the corresponding photosensitive drum 21 from the lower rear side thereof. A prescribed drum-cleaning bias is applied to each drum-cleaning roller 23. During an image-forming operation described later, the drum-cleaning rollers 23 electrostatically attract and temporarily retain toner particles and paper dust deposited on the surfaces of the photosensitive drums 21 after toner images have been transferred from the photosensitive drums 21 onto the sheet P.

The plurality of developer cartridges 20 is provided in one-to-one correspondence with the plurality of photosensitive drums 21. Each developer cartridge 20 is detachably retained in the process frame 19 at a position obliquely above and forward of the corresponding photosensitive drum 21. The plurality of developer cartridges 20 is provided for the four colors of cyan, magenta, yellow, and black, and is arranged in this order from the lower rear side to the upper front side. Each developer cartridge 20 has a box-like shape and is elongated in the left-right direction.

Each developer cartridge 20 includes a developing roller 24.

The developing roller 24 is rotatably supported in a lower end portion of the developer cartridge 20. The developing roller 24 is exposed in the lower rear side of the developer cartridge 20 and contacts the corresponding photosensitive drum 21 from the upper front side thereof.

Each developer cartridge 20 also includes a supply roller 25 that contacts the upper front side of the developing roller 24, and a thickness-regulating blade 26 that contacts the top of the developing roller 24. Each developer cartridge 20 defines an internal space formed above the supply roller 25 and the thickness-regulating blade 26 for accommodating toner therein.

(2-3) Transfer Unit

The transfer unit 17 is disposed in the main casing 2 at a position above the paper tray 6 and beneath the process unit 16.

Figure 8:
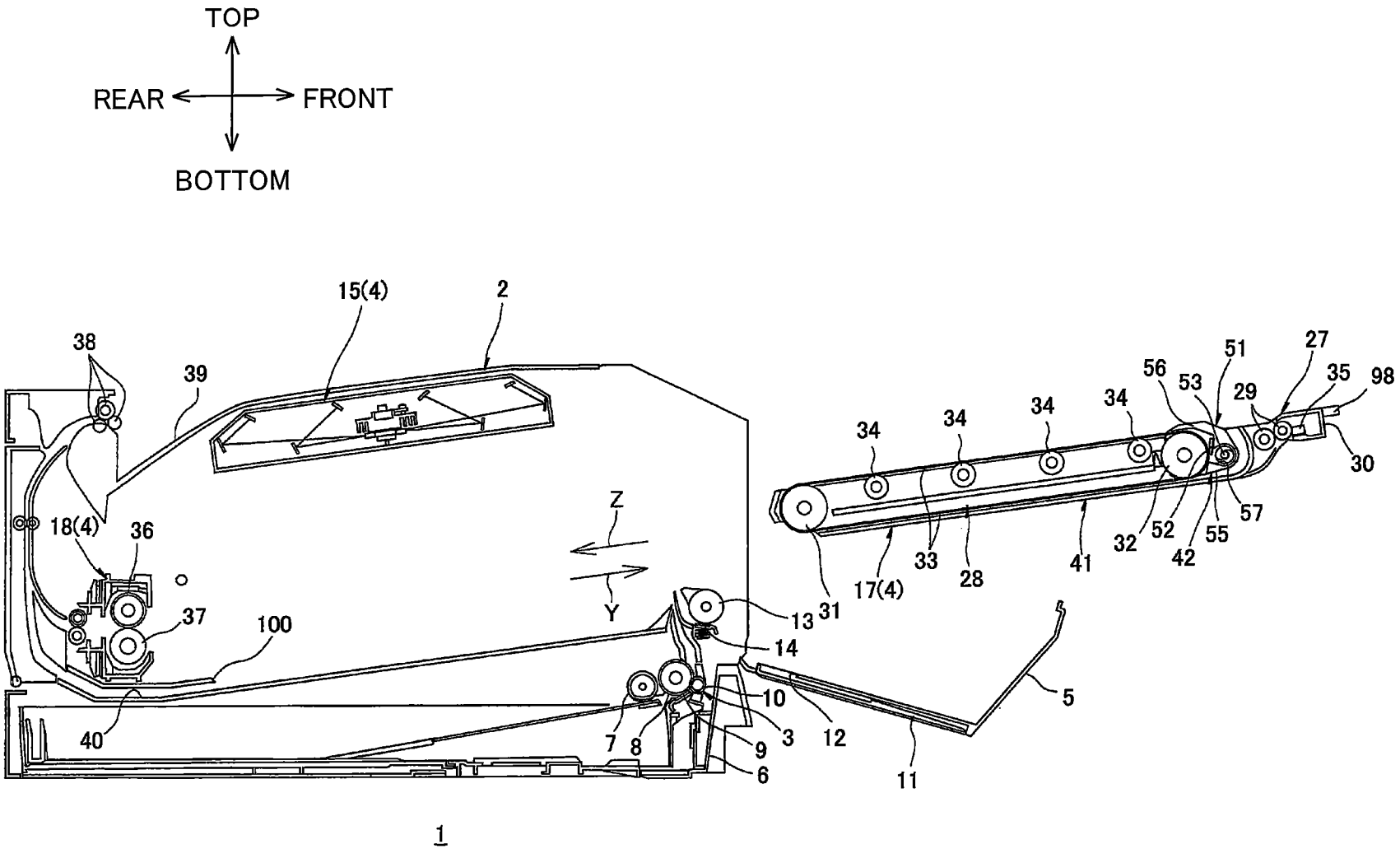
FIG. 8 is an explanatory diagram for performing maintenance operations on the transfer unit of the printer, in which both the process unit and the transfer unit have been removed from a main casing.

The transfer unit 17 is movable relative to the main casing 2 between a mounted position (see FIG. 1) and a removed position (see FIG. 8). In the mounted position, the transfer unit 17 is mounted in the main casing 2. In the removed position, the transfer unit 17 has been removed from the main casing 2.

In the mounted position, the transfer unit 17 is inclined relative to the horizontal so that its front end is positioned higher than its rear end. More specifically, the transfer unit 17 is inclined along the juxtaposed direction X.

The transfer unit 17 includes a registration portion 27, and a transfer portion 28.

The registration portion 27 is disposed at a front end portion of the transfer unit 17. The registration portion 27 includes the pair of registration rollers 29, and a paper-dust reservoir 30.

The pair of registration rollers 29 opposes each other in the front-rear direction. A drive force is inputted into the rear registration roller 29 from a drive source (not shown) provided in the main casing 2. The front registration roller 29 follows the rotation of the rear registration roller 29 and functions for removing paper dust from the surfaces of the sheets P.

The paper-dust reservoir 30 is disposed on the front side of the pair of registration rollers 29. The paper-dust reservoir 30 has a box-like shape that is open on a rear end thereof. A paper-dust scraping member 35 and a grip portion 98 are provided at the paper-dust reservoir 30.

The paper-dust scraping member 35 is disposed in a rear end portion of the paper-dust reservoir 30 and contacts the front side of the front registration roller 29. The paper-dust scraping member 35 scrapes off paper dust that has been deposited on the front registration roller 29. The paper dust scraped off the front registration roller 29 by the paper-dust scraping member 35 is collected inside the paper-dust reservoir 30.

The grip portion 98 is formed on a top portion of a front end portion of the paper-dust reservoir 30 and protrudes forward from the front end portion of the paper-dust reservoir 30. The grip portion 98 has a rectangular parallelepiped shape that is elongated in the left-right direction and substantially rectangular in a side view. In other words, the grip portion 98 is provided at the front end portion of the transfer unit 17.

The transfer portion 28 includes a drive roller 31, a follow roller 32, a conveying belt 33, and a plurality of transfer rollers 34 (four in the embodiment).

The drive roller 31 is disposed at a rear end portion of the transfer unit 17. The drive roller 31 is generally cylindrical in shape and is elongated in the left-right direction. The drive roller 31 is capable of rotating about a center axis A1 when a drive force is inputted from a drive source (not shown) provided in the main casing 2. That is, the center axis A1 extends in the left-right direction.

The follow roller 32 is disposed at the front end portion of the transfer unit 17. More specifically, the follow roller 32 is disposed on the rear side of the pair of registration rollers 29 and positioned higher than the drive roller 31. The follow roller 32 has a generally cylindrical shape and is elongated in the left-right direction. The follow roller 32 can rotate about a center axis A2. The center axis A2 of the follow roller 32 is parallel to the center axis A1 of the drive roller 31.

The conveying belt 33 is looped around the drive roller 31 and the follow roller 32, with an upper portion of the conveying belt 33 in contact with the bottom sides of the photosensitive drums 21. In other words, the photosensitive drums 21 contact the conveying belt 33 from above.

The conveying belt 33 is disposed on the rear side of the pair of registration rollers 29 so as to overlap the pair of registration rollers 29 when projected in the juxtaposed direction X.

When the drive roller 31 is driven to rotate, the conveying belt 33 circulates so that its upper portion moves along a downward slope toward the rear (i.e. from the upper front side to the lower rear side), and the follow roller 32 rotates along with the circulating movement of the conveying belt 33.

The plurality of transfer rollers 34 is provided in one-to-one correspondence with the plurality of photosensitive drums 21. Each transfer roller 34 is disposed in confrontation with the corresponding photosensitive drum 21, with the upper portion of the conveying belt 33 interposed between the top of the transfer roller 34 and the bottom of the corresponding photosensitive drum 21.

(2-4) Fixing Unit

The fixing unit 18 is disposed on the rear side of the transfer unit 17. The fixing unit 18 includes a heating roller 36, and a pressure roller 37 that contacts the heating roller 36 with pressure from below.

(3) Image Forming Operation

Toner in each of the developer cartridges 20 is supplied onto the supply roller 25, and the rotating supply roller 25 supplies the toner onto the developing roller 24 while the toner is tribocharged between the supply roller 25 and the developing roller 24.

The thickness-regulating blade 26 regulates the thickness of the toner supplied to the developing roller 24 as the developing roller 24 rotates, maintaining the toner carried on the surface of the developing roller 24 at a thin uniform thickness.

In the meantime, the scorotron charger 22 applies a uniform charge to the surface of the corresponding photosensitive drum 21. Subsequently, the photosensitive drum 21 is exposed to the laser beam emitted from the scanning unit 15, forming an electrostatic latent image on the surface of the photosensitive drum 21 based on image data.

The toner carried on the developing roller 24 is then supplied to the electrostatic latent image formed on the surface of the photosensitive drum 21 to form a toner image, that is, a developer image, thereon.

Also during this time, the sheet P is supplied from the paper tray 6 to the pair of registration rollers 29. The front registration roller 29 rotates to convey the sheet P to a position between the conveying belt 33 and the frontmost photosensitive drum 21 at a prescribed timing.

The conveying belt 33 subsequently conveys the sheet P rearward so that the sheet P passes sequentially between each photosensitive drum 21 and the corresponding transfer roller 34. At this time, toner images carried on the photosensitive drums 21 are transferred to a first surface of the sheet P to form an image thereon.

Next, the sheet P is subjected to heat and pressure while passing between the heating roller 36 and the pressure roller 37 of the fixing unit 18, thereby thermally fixing the image onto the first surface of the sheet P.

Subsequently, the sheet P is conveyed along a U-shaped path that changes the conveying direction of the sheet P from a rearward direction to a direction curved diagonally upward and forward. Discharge rollers 38 discharge the sheet P onto a discharge tray 39 formed on a top surface of the main casing 2.

(4) Reversing Path

A reversing path 40 is defined in the main casing 2, as indicated by a bold dashed line in FIG. 1. The reversing path 40 guides the sheet P from the fixing unit 18 back to the pair of registration rollers 29 after a toner image has been fixed on the first surface of the sheet P. The reversing path 40 serves as a third sheet conveying path.

The reversing path 40 extends vertically downward on the rear side of the fixing unit 18, then extends in the front-rear direction forward toward the pair of registration rollers 29 above the paper tray 6 and beneath the fixing unit 18 and the transfer unit 17.

In other words, the reversing path 40 is disposed opposite to the plurality of photosensitive drums 21 relative to the transfer unit 17.

After the toner image has been fixed on the first surface of the sheet P, the discharge rollers 38 are driven in a reverse rotation prior to discharging the sheet P onto the discharge tray 39 in order to introduce the sheet P onto the reversing path 40.

Subsequently, the sheet P is conveyed along the reversing path 40 from the rear side to the front side, with the first surface on which the toner image has been fixed facing upward. When the sheet P arrives at the pair of registration rollers 29, the pair of registration rollers 29 supplies the sheet P to a position between the frontmost photosensitive drum 21 and the conveying belt 33 with a second surface of the sheet P opposite the first surface on which the toner image has been fixed facing upward.

Then, the sheet P is sequentially conveyed to positions between the plurality of photosensitive drums 21 and the plurality of transfer rollers 34, as described above, at which time toner images are transferred from the photosensitive drums 21 onto the second surface of the sheet P to form an image thereon. The image formed on the second surface of the sheet P is thermally fixed to the second surface as the sheet P passes between the heating roller 36 and the pressure roller 37.

2. Detailed Description of Transfer Unit

Figure 3A:
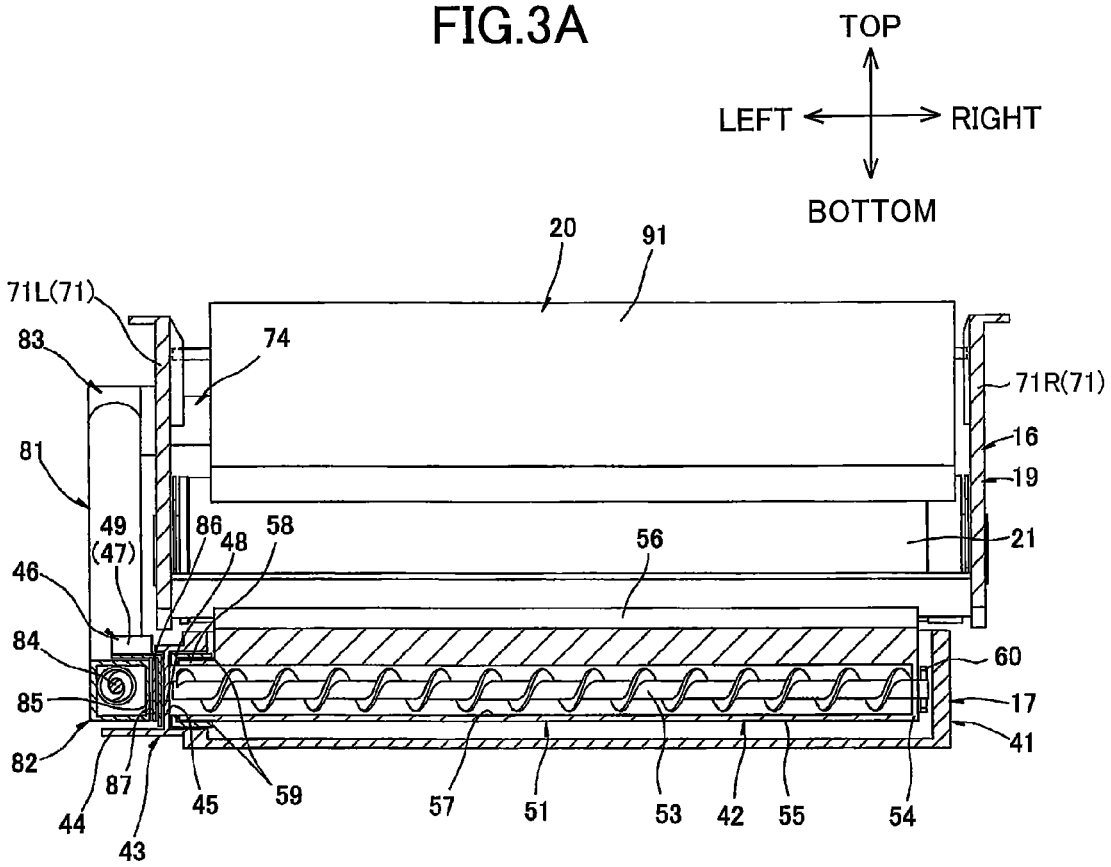
FIG. 3A is a cross-sectional view of the process unit and the transfer unit taken along a line A-A in FIG. 2.

As shown in FIGS. 3A and 4, the transfer unit 17 also includes a transfer frame 41, and a belt cleaner 42.

(1) Transfer Frame

As shown in FIG. 1, the transfer frame 41 has a frame-like configuration with a closed bottom and an open top.

The transfer portion 28 described above is accommodated inside the transfer frame 41. The registration portion 27 is integrally provided at the front end portion of the transfer frame 41.

Accordingly, the bottom wall of the transfer frame 41 is positioned in confrontation with the lower portion of the conveying belt 33 of the transfer portion 28 so as to cover the lower portion of the conveying belt 33. Further, when the transfer unit 17 is disposed in its mounted position, the bottom wall of the transfer frame 41 also defines the top of the front portion of the reversing path 40 described above. Hence, the reversing path 40 is adjacent to the lower portion of the conveying belt 33 in the vertical direction when the transfer unit 17 is disposed in its mounted position.

As shown in FIG. 3A, the transfer frame 41 includes a coupling portion 43.

The coupling portion 43 is provided on a left wall of the transfer frame 41 at a front end portion thereof. The coupling portion 43 has a generally cylindrical shape that extends in the left-right direction so as to penetrate the left wall of the transfer frame 41 and is closed on a left end thereof. The coupling portion 43 includes a support part 44, a communication hole 45, and a frame-side shutter 46.

The support part 44 has a generally arcuate shape in a side view (see FIGS. 4A, 4B) and follows a circumferential edge of the coupling portion 43. The support part 44 protrudes leftward from a lower edge on the left wall of the coupling portion 43.

The communication hole 45 is formed in the left wall of the coupling portion 43 at a lower end portion but above the support part 44. The communication hole 45 has a sector shape in a side view (see FIG. 4A) and penetrates the left wall of the coupling portion 43.

The frame-side shutter 46 is angularly rotatably supported on the left side of the left wall of the coupling portion 43 at a position above the support part 44. The frame-side shutter 46 has a generally disc shape with substantial thickness in the left-right direction. The frame-side shutter 46 includes an operating part 47, and an opening 48.

The operating part 47 is provided at a top edge of the frame-side shutter 46 when the frame-side shutter 46 is in an open position described later (see FIG. 4B). The operating part 47 has an arcuate shape that follows a circumferential edge of the frame-side shutter 46. The operating part 47 protrudes leftward from the top edge of the frame-side shutter 46. A grip part 49 is provided at a rear end portion of the operating part 47 when the frame-side shutter 46 is in the open position described later.

The grip part 49 has a generally flat plate shape and protrudes outward in a radial direction of the frame-side shutter 46 from the rear end portion of the operating part 47.

When the frame-side shutter 46 is in the open position described later, the opening 48 is positioned at a lower end portion of the frame-side shutter 46 at a position overlapping the communication hole 45. The opening 48 has a sector shape in a side view (see FIG. 4B) and penetrates the frame-side shutter 46 in the left-right direction.

Figure 4A:
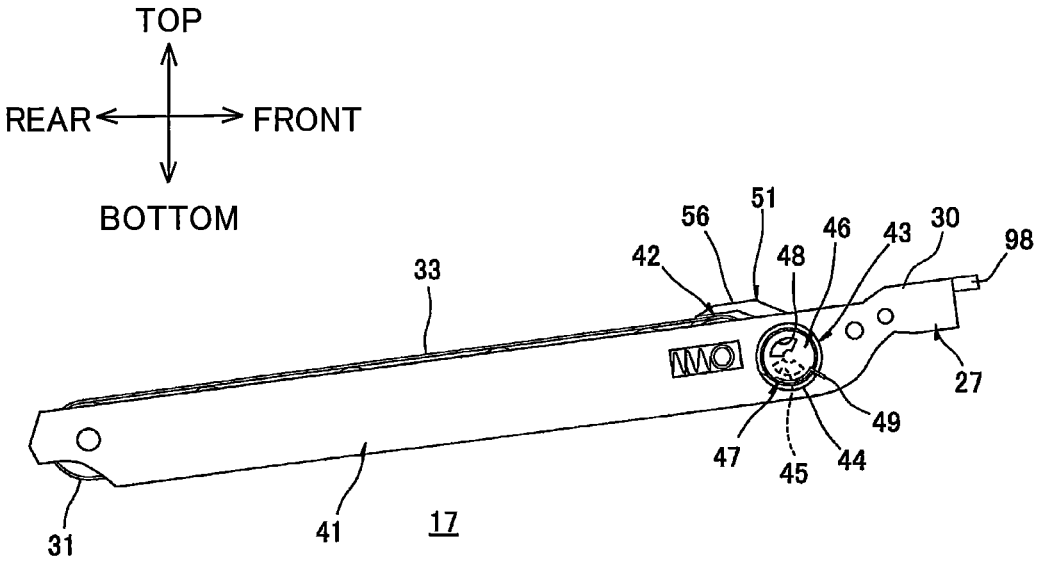
FIG. 4A is a left side view of the transfer unit shown in FIG. 1, showing a state where a frame-side shutter is in a closed position.
Figure 4B:
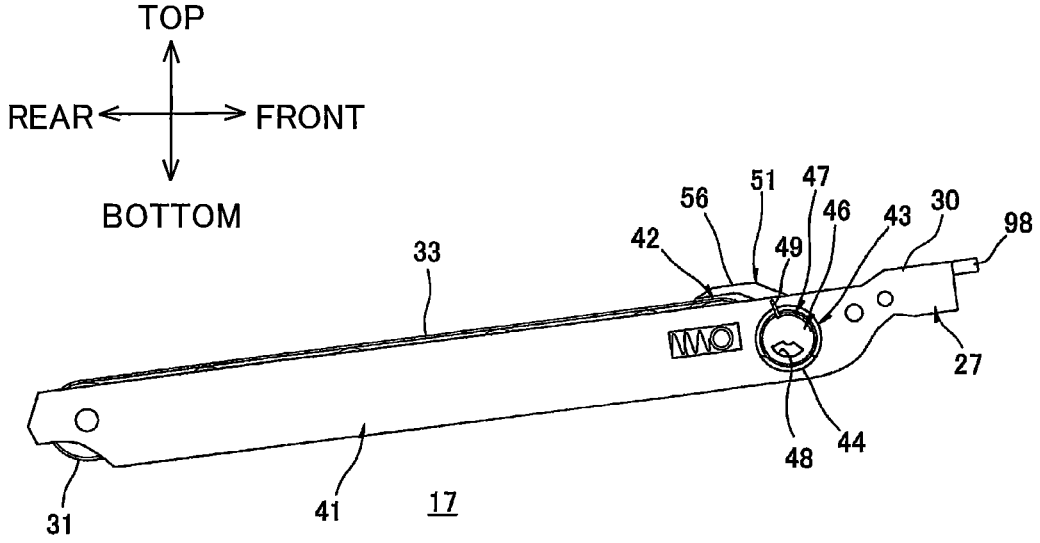
FIG. 4B is a left side view of the transfer unit shown in FIG. 1, showing a state where the frame-side shutter is in an open position.

The frame-side shutter 46 is angularly rotatably movable between a closed position (see FIG. 4A) and an open position (see FIG. 4B). In the closed position, the opening 48 in the frame-side shutter 46 is disposed above the communication hole 45 so as not to be aligned with the communication hole 45. In the open position, the opening 48 is aligned with the communication hole 45.

(2) Belt Cleaner

As shown in FIGS. 1 and 3A, the belt cleaner 42 is accommodated in the front end portion of the transfer frame 41 at a position rearward of the pair of registration rollers 29. The belt cleaner 42 includes a cleaner frame 51, a cleaning blade 52, and a first screw 53.

The cleaner frame 51 is formed in a generally cylindrical shape that is closed on both left and right ends thereof and is open on a lower rear end thereof. More specifically, the cleaner frame 51 integrally has a side wall 54, a main body 55, and a top wall 56.

The side wall 54 has a flat plate shape and is generally rectangular in a side view. The side wall 54 is disposed on the right side of the cleaner frame 51.

The main body 55 extends leftward from a front end portion of the side wall 54. The main body 55 is generally columnar in shape, with a curved front end portion that gives the main body 55 a generally D-shaped cross-section. The main body 55 includes a recovery chamber 57, and a fitting part 58.

The recovery chamber 57 is a recessed groove elongated in the left-right direction. More specifically, the recovery chamber 57 is recessed frontward from a rear edge of the main body 55. A cross-section of the main body 55 is generally U-shaped and open on a rear end thereof.

The fitting part 58 is generally cylindrical in shape and extends leftward from a left end portion of the main body 55. The fitting part 58 has a right end portion in communication with a left end portion of the recovery chamber 57. The fitting part 58 has an outer diameter smaller than an inner diameter of the coupling portion 43 of the transfer frame 41. The fitting part 58 also includes a sealing member 59.

The sealing member 59 has a generally flat plate shape and is formed of a resilient material, such as a sponge. The sealing member 59 is wrapped around the fitting part 58, covering an outer circumferential surface of the fitting part 58.

The top wall 56 has a generally flat plate shape and extends rearward from a top edge of the main body 55. The top wall 56 has a rear edge extending to a position farther forward than the frontmost transfer roller 34.

The cleaning blade 52 is provided at a rear edge of a top portion of the main body 55. The cleaning blade 52 has a generally flat plate shape and is elongated in the left-right direction, with substantial thickness in the front-rear direction. The cleaning blade 52 has an upper half portion fixed to a top peripheral edge of the main body 55 defining the recovery chamber 57 and a lower half portion confronting an upper half portion of the recovery chamber 57.

The first screw 53 is a left-handed auger screw extending in the left-right direction and aligned with a center axis of the fitting part 58. The first screw 53 has a right end portion that is rotatably supported at the side wall 54 of the belt cleaner 42. The first screw 53 includes a first screw drive gear 60.

The first screw drive gear 60 is supported at the right end portion of the first screw 53 on the right side of the side wall 54 and is non-rotatable relative to the first screw 53. A drive force is inputted into the first screw drive gear 60 from the main casing 2 through a gear train (not shown).

The belt cleaner 42 is supported at the transfer frame 41 by fitting the fitting part 58 into the coupling portion 43 of the transfer frame 41 from the right side thereof. In this state, the sealing member 59 is interposed between the fitting part 58 and the coupling portion 43 in a compressed state.

The cleaning blade 52 has a bottom edge confronting the front side of the follow roller 32 with the conveying belt 33 interposed therebetween. Thus, the bottom edge of the cleaning blade 52 contacts the front side of the conveying belt 33 looped about the follow roller 32. The cleaning blade 52 is also positioned near the lower front side of the frontmost photosensitive drum 21. The cleaning blade 52 is also positioned below an imaginary plane I containing a top surface of the upper portion of the conveying belt 33.

3. Detailed Description of Process Unit (1) Process Frame

As shown in FIGS. 1, 2, 3A and 3B, the process frame 19 has a frame-like configuration that is generally rectangular in a plan view. The process frame 19 includes a pair of side walls 71, a front beam 72, and a rear beam 73. Hereinafter, the side wall 71 on the left side will be referred to as a left side wall 71L and the side wall 71 on the right side will be referred to as the right side wall 71R, when it is necessary to distinguish between the two.

The pair of side walls 71 is each generally rectangular in a side view (see FIG. 2) and elongated in the front-rear direction. The pair of side walls 71 is arranged parallel to each other and separated in the left-right direction. As described above, the plurality of photosensitive drums 21, the plurality of scorotron chargers 22, and the plurality of drum-cleaning rollers 23 are supported between the pair of side walls 71. The left side wall 71L also includes an intermediary conveying portion 74 (see FIGS. 3A and 3B).

The intermediary conveying portion 74 is provided at a rear end portion of the left side wall 71L at approximately a vertical center thereof. The intermediary conveying portion 74 has a generally cylindrical shape that is closed on a right end thereof and extends in the left-right direction, penetrating the left side wall 71L. The intermediary conveying portion 74 includes a supply hole 75, and a relay screw 76.

The supply hole 75 is formed so as to penetrate a lower end portion of the intermediary conveying portion 74 at a right end portion thereof.

The relay screw 76 is a left-handed auger screw that extends in the left-right direction along a center axis of the intermediary conveying portion 74. A right end portion of a rotational shaft in the relay screw 76 is rotatably supported at a right wall of the intermediary conveying portion 74. The relay screw 76 also includes an engaging protrusion 77.

The engaging protrusion 77 extends rightward from the right end portion of the relay screw 76 and protrudes in a radial direction of the relay screw 76.

The front beam 72 bridges front end portions of the pair of side walls 71. The front beam 72 has a generally flat plate shape and is elongated in the left-right direction, with substantial thickness in the front-rear direction.

The rear beam 73 bridges rear end portions of the pair of side walls 71. The rear beam 73 has a generally flat plate shape and is elongated in the left-right direction, with substantial thickness in the front-rear direction.

(2) Conveying Tube

The process unit 16 also includes a conveying tube 81.

Figure 2:
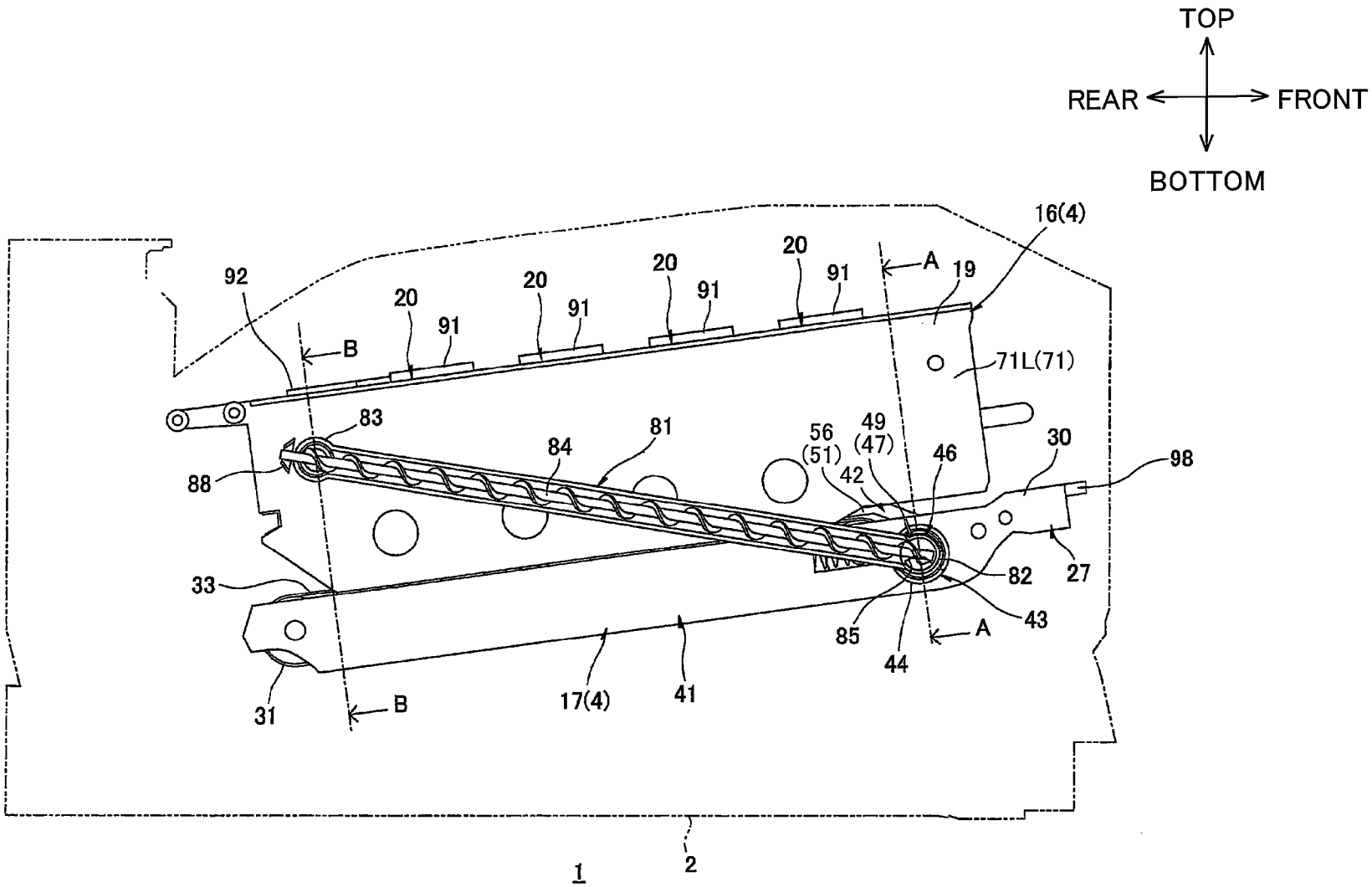
FIG. 2 is a left side view of a process unit and a transfer unit shown in FIG. 1.
Figure 3B:
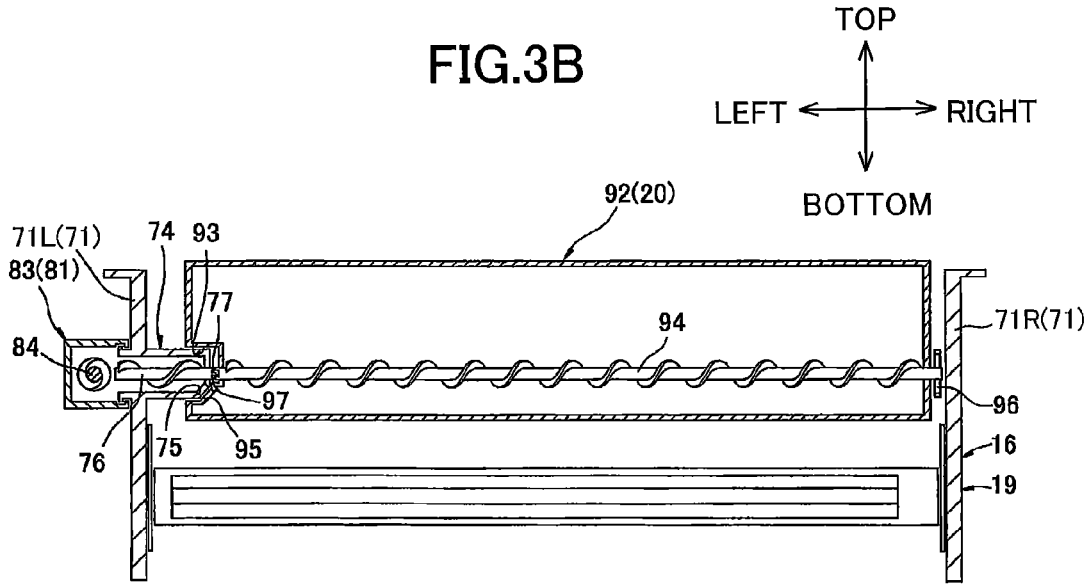
FIG. 3B is a cross-sectional view of the process unit and the transfer unit taken along a line B-B in FIG. 2.

The conveying tube 81 is supported on the left side of the left side wall 71L of the process frame 19. The conveying tube 81 is formed in a generally cylindrical shape that is closed on both front and rear ends thereof and is elongated in the front-rear direction. As shown in FIGS. 2, 3A and 3B, the conveying tube 81 includes an accommodating-portion-side fitting part 83, a cleaner-side fitting part 82, and a second screw 84.

As shown in FIGS. 2 and 3B, the accommodating-portion-side fitting part 83 is provided at a rear end portion of the conveying tube 81. The accommodating-portion-side fitting part 83 has a generally cylindrical shape that is closed on a left end thereof and is elongated in the left-right direction. The accommodating-portion-side fitting part 83 is fitted around a left end portion of the intermediary conveying portion 74 so as to be rotatable relative to the intermediary conveying portion 74.

As shown in FIGS. 2 and 3A, the cleaner-side fitting part 82 is provided at a front end portion of the conveying tube 81. The cleaner-side fitting part 82 has a generally cylindrical shape that is closed on both left and right ends thereof and is elongated in the left-right direction. The cleaner-side fitting part 82 is fitted into the support part 44 of the transfer frame 41 from above. The cleaner-side fitting part 82 includes a receiving hole 85, and a conveying-tube-side shutter 86.

The receiving hole 85 penetrates a right wall of the cleaner-side fitting part 82 at a lower end portion thereof and has a shape the same as that of the communication hole 45 formed in the transfer frame 41.

The conveying-tube-side shutter 86 is angularly rotatably supported on the right side of the right wall of the cleaner-side fitting part 82. The conveying-tube-side shutter 86 has a generally disc shape, with substantial thickness in the left-right direction. The conveying-tube-side shutter 86 is engaged with the frame-side shutter 46 and non-rotatable relative to the frame-side shutter 46 when the cleaner-side fitting part 82 is fitted into the support part 44 of the transfer frame 41. An opening 87 is also formed in the conveying-tube-side shutter 86.

The opening 87 is formed in a shape the same as that of the opening 48 formed in the frame-side shutter 46. The opening 87 penetrates the conveying-tube-side shutter 86 at a position aligned with the opening 48 of the frame-side shutter 46 when the conveying-tube-side shutter 86 is non-rotatably engaged with the frame-side shutter 46.

The conveying-tube-side shutter 86 is angularly rotatably movable together with the frame-side shutter 46 between a closed position (see FIG. 5) and an open position (see FIG. 3A). In the closed position, the opening 87 in the conveying-tube-side shutter 86 is disposed above the receiving hole 85 so as not to be aligned with the receiving hole 85. In the open position, the opening 87 is aligned with the receiving hole 85.

Figure 6:
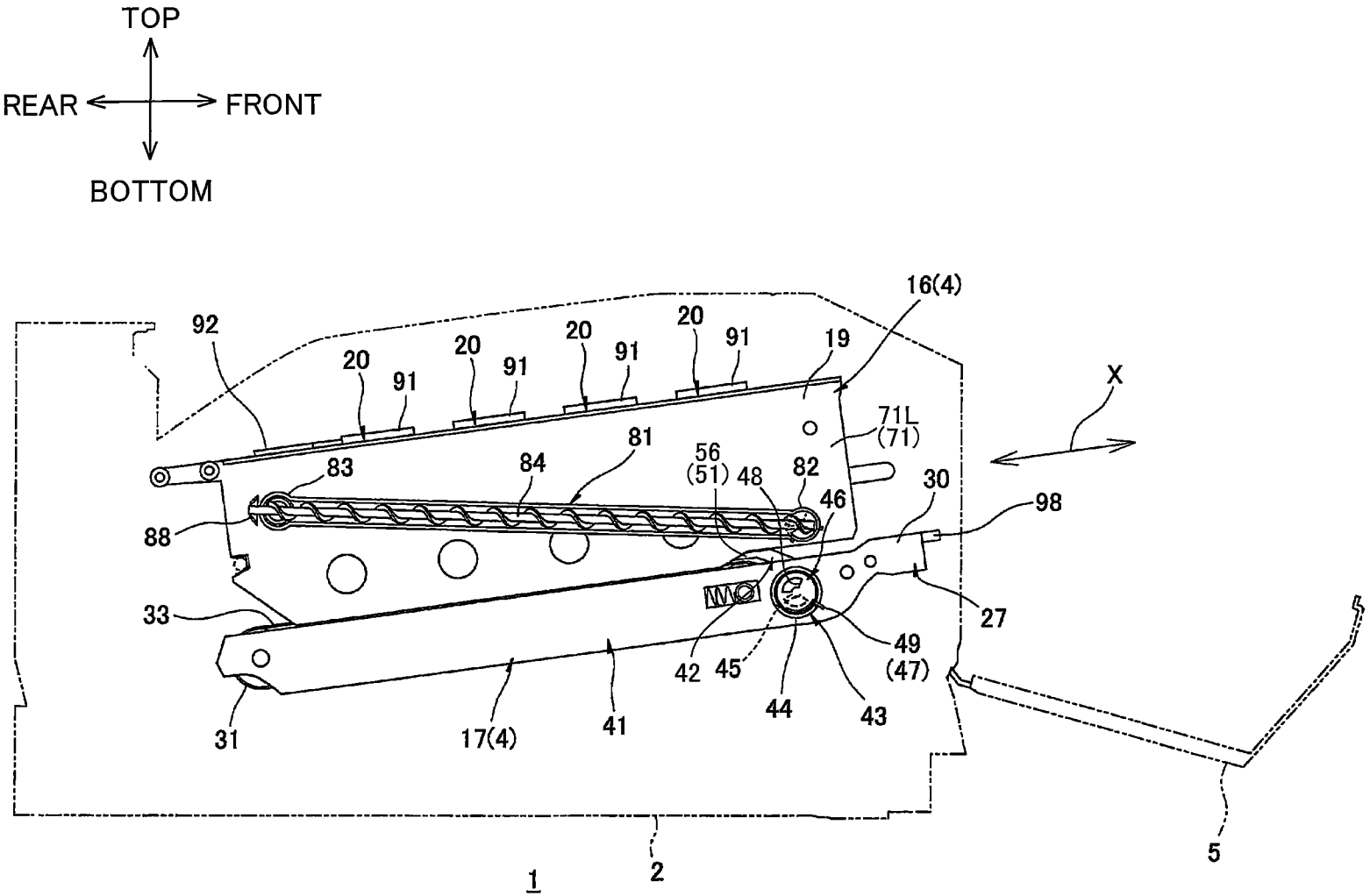
FIG. 6 is an explanatory diagram, following FIG. 5, for performing the maintenance operations on the developer cartridge, in which a cleaner-side fitting part of a conveying tube is separated above a coupling portion of the transfer unit.

As shown in FIG. 6, the conveying tube 81 is pivotally movable about the accommodating-portion-side fitting part 83 so that the cleaner-side fitting part 82 moves upward and separates from the coupling portion 43 while the frame-side shutter 46 and the conveying-tube-side shutter 86 are in their closed positions.

The second screw 84 is a right-handed auger screw extending in the front-rear direction within the conveying tube 81. The second screw 84 has a front end portion disposed inside the cleaner-side fitting part 82. The second screw 84 has a rear end portion that is rotatably supported at a circumferential wall on the rear side of the accommodating-portion-side fitting part 83. The second screw 84 includes a second screw drive gear 88.

The second screw drive gear 88 is supported at the rear end portion of the second screw 84 on the rear side of the accommodating-portion-side fitting part 83 and is non-rotatable relative to the second screw 84. A drive force is inputted into the second screw drive gear 88 from the main casing 2 through a gear train (not shown).

(3) Developer Cartridges

Figure 7:
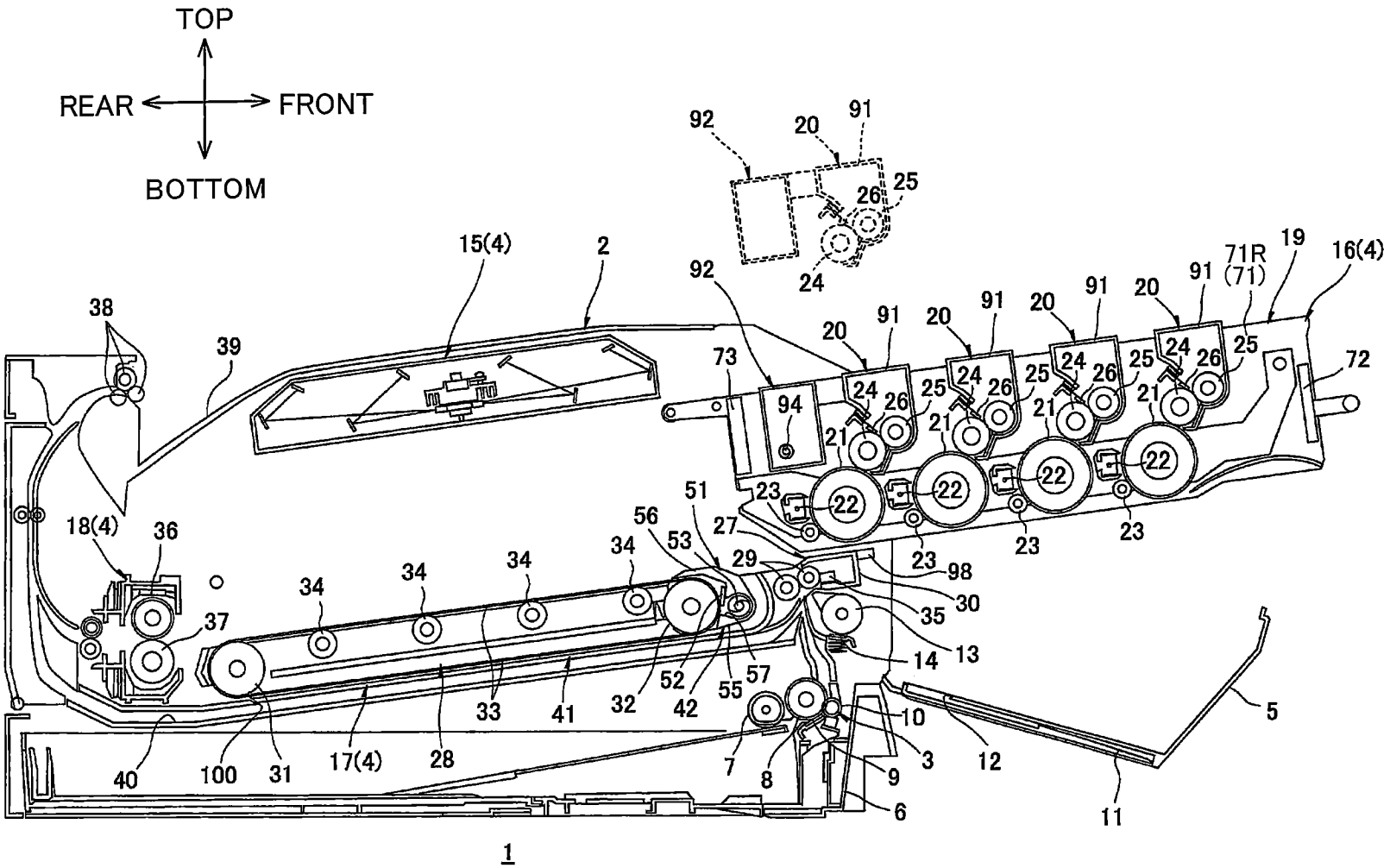
FIG. 7 is an explanatory diagram, following FIG. 6, for performing the maintenance operations on the developer cartridge, in which the process unit is in a withdrawn position.

As shown in FIGS. 3A and 7, each developer cartridge 20 includes a developer frame 91.

The developer frame 91 has a box-like shape and is elongated in the left-right direction. As described above, the developing roller 24, the supply roller 25, and the thickness-regulating blade 26 are supported at a bottom portion of the developer frame 91, while an upper portion thereof serves to accommodate toner therein.

The rearmost developer cartridge 20 further includes an accommodating portion 92 (see also FIG. 3B). That is, the accommodating portion 92 is disposed adjacent to the rearmost photosensitive drum 21.

The accommodating portion 92 is integrally provided on the rear side of the developer frame 91 and has a box-like shape that is elongated in the left-right direction. As shown in FIG. 1, the accommodating portion 92 is disposed above the imaginary plane I.

As shown in FIGS. 3B and 7, the accommodating portion 92 includes a receiving recessed part 93, and an accommodating-portion screw 94.

The receiving recessed part 93 has a generally cylindrical shape that is closed on a right end thereof. The receiving recessed part 93 extends rightward so as to be recessed rightward from a left wall of the accommodating portion 92. A recovery hole 95 is formed in the receiving recessed part 93.

The recovery hole 95 is formed so as to penetrate a right end portion of the receiving recessed part 93 at a lower end portion thereof, providing communication between the interior and exterior of the accommodating portion 92.

The accommodating-portion screw 94 is disposed in the accommodating portion 92. The accommodating-portion screw 94 is a left-handed auger screw that extends in the left-right direction. The accommodating-portion screw 94 has a right end portion that is rotatably supported at a right wall of the accommodating portion 92. The right end portion of the accommodating-portion screw 94 protrudes rightward from the right wall of the accommodating portion 92. The accommodating-portion screw 94 has a left end portion that is rotatably supported at a right wall of the receiving recessed part 93. The left end portion of the accommodating-portion screw 94 protrudes into the receiving recessed part 93. The accommodating-portion screw 94 includes an accommodating-portion screw drive gear 96, and an engaging recessed part 97.

The accommodating-portion screw drive gear 96 is supported at the right end portion of the accommodating-portion screw 94 on the right side of the accommodating portion 92 and is non-rotatable relative to the accommodating-portion screw 94. A drive force is inputted into the accommodating-portion screw drive gear 96 from the main casing 2 through a gear train (not shown).

The engaging recessed part 97 is a recessed groove that is recessed rightward from the left end portion of the accommodating-portion screw 94.

While the rearmost developer cartridge 20 is supported in the process frame 19, the intermediary conveying portion 74 is fitted inside the receiving recessed part 93 of the accommodating portion 92.

In this state, the engaging protrusion 77 of the relay screw 76 is engaged with the engaging recessed part 97 of the accommodating-portion screw 94. With this configuration, the relay screw 76 is coupled to the accommodating-portion screw 94 and non-rotatable relative to the accommodating-portion screw 94. Further, the recovery hole 95 of the receiving recessed part 93 confronts the supply hole 75 of the intermediary conveying portion 74.

4. Recovery of Extraneous Matter

During the image-forming operation described above, a paper dust removing operation on the front registration roller 29 (paper-dust removing roller), a cleaning operation on the conveying belt 33 and cleaning operations on the respective photosensitive drums 21 are executed. Next, these cleaning operations will be described with reference to FIGS. 1, 2, 3A and 3B.

When the image-forming operation described above is implemented on the printer 1, paper dust deposited on the surface of the sheet P is captured by the front registration roller 29 when the sheet P is conveyed opposite the front registration roller 29, and the paper dust is temporarily retained on the front registration roller 29. The paper dust captured on the front registration roller 29 subsequently moves opposite the paper-dust scraping member 35 as the rear registration roller 29 rotates and is scraped off the front registration roller 29 by the paper-dust scraping member 35 and collected in the paper-dust reservoir 30.

Further, a cleaning bias is applied to the drum-cleaning rollers 23. Through this cleaning bias, residual toner, paper dust, and other extraneous matter deposited on the surfaces of the photosensitive drums 21 are attracted to and temporarily retained on circumferential surfaces of the corresponding drum-cleaning rollers 23 as the extraneous matter rotates opposite the drum-cleaning rollers 23.

Extraneous matter deposited on the surface of the conveying belt 33 circulates together with the conveying belt 33 until reaching an area of contact between the conveying belt 33 and the cleaning blade 52. At this time, the cleaning blade 52 scrapes the extraneous matter off the conveying belt 33, and the extraneous matter is collected in the recovery chamber 57 of the cleaner frame 51.

The rotating first screw 53 subsequently conveys the extraneous matter collected in the recovery chamber 57 of the cleaner frame 51 leftward toward a left end portion of the cleaner frame 51. Then, the extraneous matter is sequentially conveyed from the left end portion of the cleaner frame 51 to the cleaner-side fitting part 82 of the conveying tube 81 through the communication hole 45 of the transfer frame 41, the opening 48 of the frame-side shutter 46, the opening 87 of the conveying-tube-side shutter 86, and the receiving hole 85 of the conveying tube 81.

Next, the rotating second screw 84 conveys the extraneous matter conveyed in the cleaner-side fitting part 82 from the front end portion of the conveying tube 81 toward the rear end portion thereof, and introduces the extraneous matter into the left end portion of the intermediary conveying portion 74.

Here, the rotating relay screw 76 conveys the extraneous matter introduced into the left end portion of the intermediary conveying portion 74 toward the right end portion of the intermediary conveying portion 74. Then, the extraneous matter sequentially passes through the supply hole 75 and the recovery hole 95, and is collected in the accommodating portion 92.

The rotating accommodating-portion screw 94 then conveys the extraneous matter collected in the accommodating portion 92 rightward in the accommodating portion 92. Thus, the extraneous matter conveyed to the accommodating portion 92 is uniformly distributed within the accommodating portion 92 with respect to the left-right direction.

Once the image-forming operation described above has completed, the drum-cleaning bias is controlled so that the extraneous matter temporarily retained on the drum-cleaning rollers 23 is expelled back onto the corresponding photosensitive drums 21.

As the photosensitive drums 21 rotate, the extraneous matter returned to the photosensitive drums 21 rotates toward the conveying belt 33 and is thereby expelled onto the conveying belt 33.

The extraneous matter expelled onto the conveying belt 33 is subsequently recovered by the belt cleaner 42 as the conveying belt 33 circulates, as described above, and is conveyed to the accommodating portion 92 through the conveying tube 81.

5. Maintenance on Developer Cartridges

To perform maintenance on the developer cartridge 20, the user initially pulls the process unit 16 out to the withdrawn position.

Figure 5:
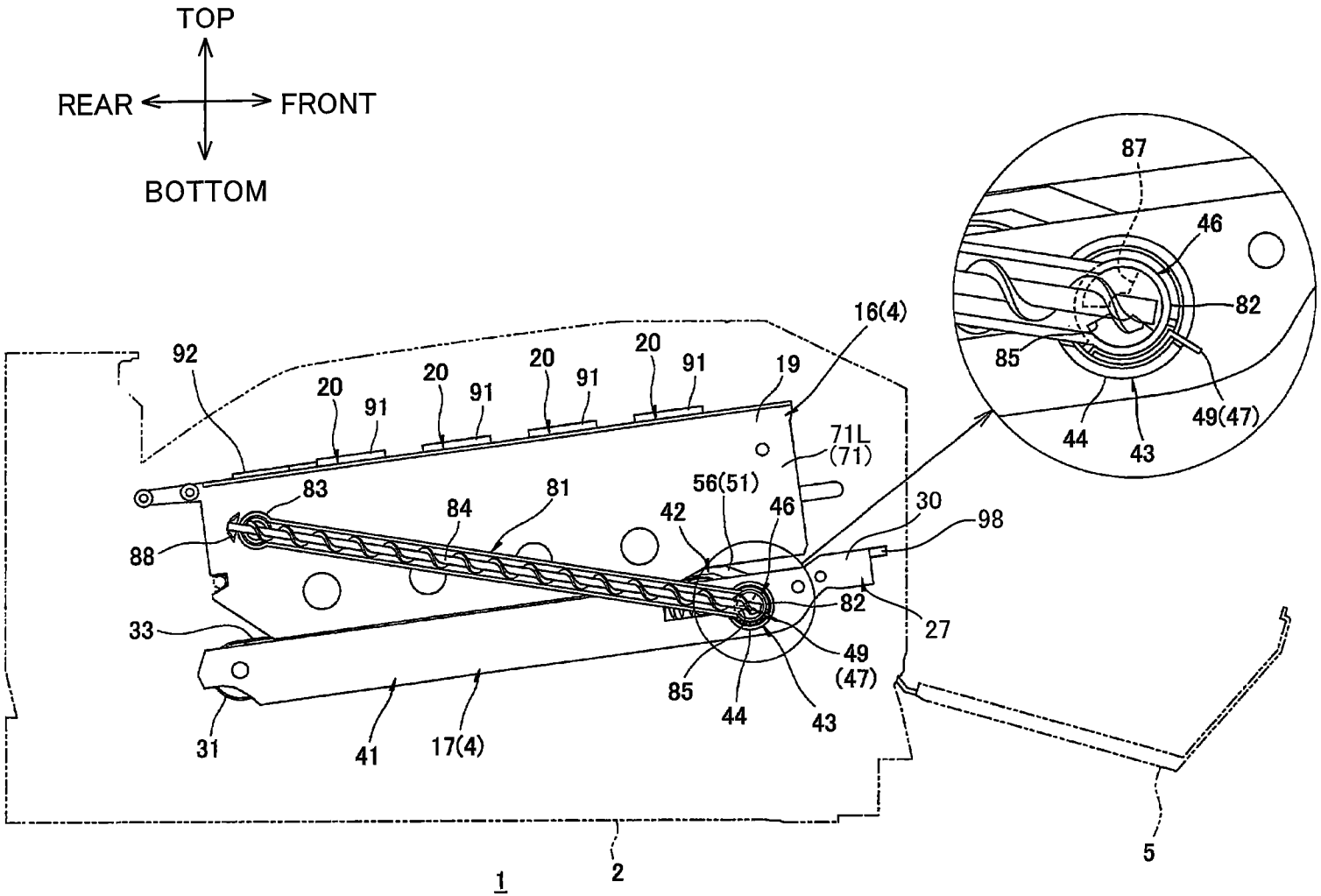
FIG. 5 is an explanatory diagram for performing maintenance operations on a developer cartridge of the printer, in which a front cover is open and the frame-side shutter is in the closed position.

More specifically, first the user opens the front cover 5 on the main casing 2, as shown in FIG. 5.

Next, the user grips the grip part 49 of the frame-side shutter 46 and angularly rotatably moves the frame-side shutter 46 clockwise in a left side view. Through this operation, the frame-side shutter 46 is moved from its open position to its closed position. At this time, both the frame-side shutter 46 and the conveying-tube-side shutter 86 are in their closed positions, blocking the communication hole 45 of the transfer frame 41 and the receiving hole 85 of the conveying tube 81.

Next, as shown in FIG. 6, the user pivotally moves the conveying tube 81 counterclockwise in a left side view about the center axis of the accommodating-portion-side fitting part 83, thereby moving the cleaner-side fitting part 82 upward away from the coupling portion 43.

Subsequently, the user pulls the process unit 16 forward along the juxtaposed direction X into the withdrawn position.

In order to perform maintenance on the developer cartridge 20, the user removes the developer cartridge 20 from the process unit 16, as shown in FIG. 7.

To remove any of the developer cartridges 20 except the rearmost developer cartridge 20 from the process unit 16, the user simply pulls the developer cartridge 20 upward from the process unit 16. Accordingly, the developer cartridge 20 is separated from the process unit 16.

To remove the rearmost developer cartridge 20, on the other hand, the user first pulls up on the right end portion of the rearmost developer cartridge 20 to separate the intermediary conveying portion 74 of the transfer frame 41 from the receiving recessed part 93 of the accommodating portion 92.

Through this operation, the rearmost developer cartridge 20 is separated from the process unit 16. At the same time, the accommodating portion 92 is also separated from the process unit 16 together with the rearmost developer cartridge 20.

Thereafter, the user can perform maintenance on the developer cartridge 20.

The developer cartridge 20 is mounted in the main casing 2 by performing the operation to remove the developer cartridge 20 described above in reverse.

That is, when mounting any of the developer cartridges 20 except the rearmost developer cartridge 20 in the main casing 2, the user first positions the developer cartridge 20 above the process unit 16 and inserts the developer cartridge 20 downward into the process unit 16 until the developer cartridge 20 is mounted therein.

When mounting the rearmost developer cartridge 20 in the main casing 2, the user first inserts the left end portion of the rearmost developer cartridge 20 into the process unit 16 in order that the intermediary conveying portion 74 of the transfer frame 41 is fitted into the receiving recessed part 93 of the accommodating portion 92.

Once the intermediary conveying portion 74 is fitted into the receiving recessed part 93 and the right end portion of the developer cartridge 20 is pushed downward, the developer cartridge 20 is completely mounted in the process unit 16.

To finish mounting the developer cartridge 20 in the main casing 2, the user pushes the process unit 16 rearward into the main casing 2, as shown in FIG. 6. More specifically, the user moves the process unit 16 rearward along the juxtaposed direction X. As a result, the process unit 16 is accommodated in the main casing 2.

Next, the user pivotally moves the conveying tube 81 clockwise in a left side view about the center axis of the accommodating-portion-side fitting part 83 until the cleaner-side fitting part 82 is fitted into the coupling portion 43, as shown in FIG. 5.

Next, the user grips the grip part 49 of the frame-side shutter 46 and angularly rotatably moves the frame-side shutter 46 counterclockwise in a left side view from the closed position to the open position, as shown in FIG. 2. Through this operation, both the frame-side shutter 46 and the conveying-tube-side shutter 86 are in their open positions so as to uncover the communication hole 45 of the transfer frame 41 and the receiving hole 85 of the conveying tube 81.

Lastly, the user closes the front cover 5 on the main casing 2.

6. Maintenance on Transfer Unit and Paper Jam Resolution

In order to perform maintenance on the transfer unit 17 or to remove the sheet P that has become jammed in the reversing path 40, the user removes the transfer unit 17 from the main casing 2 after removing the process unit 16 from the main casing 2, as shown in FIG. 8.

To remove the transfer unit 17 from the main casing 2, the user pulls the process unit 16 out to the withdrawn position, as described above, and removes the process unit 16 from the main casing 2, as shown in FIG. 8.

Next, the user grips the grip portion 98 of the transfer unit 17 and pulls the transfer unit 17 in a direction sloping upward and forward.

With the transfer unit 28 and the registration unit 27 integrally provided in the transfer unit 17, the transfer unit 17 moves along a removal direction Y sloping upward toward the front from the mounted position to the removed position. In other words, the grip portion 98 is provided on the downstream end portion of the transfer unit 17 with respect to the removal direction Y.

Through this operation, the transfer unit 17 is moved into the removed position outside of the main casing 2.

By removing the transfer unit 17, the bottom wall of the transfer frame 41 is no longer present in the front portion of the reversing path 40, leaving an open region 100 in the top of the reversing path 40. Accordingly, if a sheet P becomes jammed in the reversing path 40, the user can hold and remove the jammed sheet P through the open region 100 formed in the reversing path 40.

When performing maintenance on the transfer unit 17 to replace components or the like, for example, this maintenance is performed when the transfer unit 17 is in its removed position.

After clearing the paper jam or after completing maintenance on the transfer unit 17, as described above, the user remounts the transfer unit 17 in the main casing 2.

The transfer unit 17 is remounted by performing the operation to remove the transfer unit 17 described above in reverse. That is, the user grips the grip portion 98 of the transfer unit 17 and inserts the transfer unit 17 toward its mounted position along a mounting direction Z sloping downward toward the rear.

Once the transfer unit 17 arrives in its mounted position, the bottom wall of the transfer frame 41 is fitted into the open region 100 formed in the reversing path 40, as shown in FIG. 1. Hence, the transfer unit 17 can move between its mounted position and its removed position while the transfer unit 28 and the registration unit 27 are integrally provided thereon.

Lastly, the user closes the front cover 5 on the main casing 2.

7. Operational Advantages (1) In the printer 1 according to the first embodiment described above, the belt cleaner 42 is disposed near the frontmost photosensitive drum 21, which is the photosensitive drum 21 closest to the follow roller 32, and the follow roller 32 is positioned higher than the drive roller 31, as shown in FIGS. 1 and 2. The extraneous matter removed by the belt cleaner 42 can be conveyed to the accommodating portion 92 positioned near the rearmost photosensitive drum 21, which is the photosensitive drum 21 closest to the drive roller 31.

This configuration shortens the vertical distance between the belt cleaner 42 and the accommodating portion 92 by the vertical difference between the drive roller 31 and the follow roller 32.

Thus, the slope of the conveying tube 81 relative to a horizontal plane can be made smaller than the angle of repose of the toner, making it easier to convey extraneous matter removed by the belt cleaner 42 to the accommodating portion 92. In other words, this configuration facilitates the use of toner having greater fluidity for achieving higher quality images.

(2) In the printer 1 according to the first embodiment described above, as shown in FIGS. 2 and 3, the first screw 53 moves extraneous matter removed by the belt cleaner 42 leftward to collect the extraneous matter on the left end of the belt cleaner 42 so that the second screw 84 can efficiently convey the extraneous matter to the accommodating portion 92.

(3) In the printer 1 according to the first embodiment described above, as shown in FIG. 7, the process frame 19 allows the plurality of developer cartridges 20 to be pulled out of the main casing 2 together in order to better facilitate maintenance on the developer cartridges 20 and the accommodating portion 92.

(4) In the printer 1 according to the first embodiment described above, as shown in FIG. 1, the drive roller 31 is disposed on the rear end portion of the transfer unit 17, and specifically the upstream end portion thereof with respect to the direction in which the process unit 16 is pulled out of the main casing 2.

Accordingly, the rear end portion of the process unit 16 can be positioned lower than its front end portion.

Thus, when inserting the process unit 16 into the main casing 2, the weight of the process unit 16 can be utilized to facilitate the mounting motion.

(5) In the printer 1 according to the first embodiment described above, as shown in FIGS. 5 and 6, the transfer unit 17 and the conveying tube 81 are coupled or uncoupled through the coupling portion 43 provided on the front end portion of the process unit 16.

This arrangement facilitates operations for coupling and uncoupling the transfer unit 17 and the conveying tube 81 since the grip part 49 of the frame-side shutter 46 can be operated from the front side of the printer 1.

(6) In the printer 1 according to the first embodiment described above, by positioning the belt cleaner 42 to the front side of the follow roller 32, as shown in FIG. 3, the vertical distance between the belt cleaner 42 and the accommodating portion 92 can be made shorter than when the belt cleaner 42 is disposed beneath the follow roller 32.

(7) In the printer 1 according to the first embodiment, as shown in FIGS. 1 and 8, the transfer unit 17 is moved between its mounted position and its removed position when it is necessary to perform maintenance on the transfer unit 17 and the like. During this movement, the conveying belt 33 and the pair of registration rollers 29 are integrally moved with the transfer unit 17.

Therefore, the pair of registration rollers 29 is unlikely to interfere with the mounting and removal operations for the transfer unit 17.

Thus, this configuration facilitates the smooth mounting and removal operations on the transfer unit 17 relative to the main casing 2, thereby facilitating smooth maintenance operations on the transfer unit 17.

(8) The front registration roller 29 shown in FIG. 1 serves as a paper dust roller for capturing paper dust from the sheets P.

Hence, when the pair of registration rollers 29 conveys the sheet P during the image-forming operation, the front registration roller 29 captures paper dust from the surface of the sheet P. The paper dust captured on the front registration roller 29 is subsequently scraped off the front registration roller 29 by the paper-dust scraping member 35 and collected in the paper-dust reservoir 30.

Thus, this configuration can reduce the amount of paper dust deposited on the conveying belt 33 and the photosensitive drums 21, reducing the likelihood of image formation problems caused by paper dust deposits.

When the transfer unit 17 is moved between its mounted position and its removed position, not only the conveying belt 33 and the pair of registration rollers 29, but also the paper-dust scraping member 35 and the paper-dust reservoir 30 move integrally with the transfer unit 17, as shown in FIG. 8. Therefore, maintenance can be performed on both the paper-dust scraping member 35 and the paper-dust reservoir 30 at the same time maintenance is performed on the transfer unit 17. Further, the paper-dust scraping member 35 and the paper-dust reservoir 30 are unlikely to interfere with the mounting and removal operations for the transfer unit 17.

Thus, this configuration suppresses the occurrence of image formation problems while facilitating smooth mounting and removal operations of the transfer unit 17 relative to the main casing 2.

(9) As shown in FIG. 1, the pair of registration rollers 29 overlaps the conveying belt 33 when projected in the juxtaposed direction X, which is the direction in which the photosensitive drums 21 are juxtaposed.

This arrangement reliably reduces the likelihood of the pair of registration rollers 29 interfering with the mounting and removal operations of the transfer unit 17 when the transfer unit 17 is moved between the mounted position and the removed position, as shown in FIG. 8.

(10) As shown in FIGS. 1 and 7, the printer 1 according to the first embodiment includes the process frame 19 for supporting the plurality of photosensitive drums 21. The process frame 19 can move between the accommodated position in which the process frame 19 is accommodated in the main casing 2, and the withdrawn position in which the process frame 19 is withdrawn to the outside of the main casing 2.

Hence, the process frame 19 allows the plurality of photosensitive drums 21 to be pulled out of the main casing 2 together in order to facilitate maintenance on the photosensitive drums 21.

In particular, the process frame 19 can move between the accommodated position and the withdrawn position along the juxtaposed direction X, while the pair of registration rollers 29 and the conveying belt 33 overlap each other when projected in the juxtaposed direction X. Put another way, the pair of registration rollers 29 is positioned so as not to overlap the process frame 19 when projected in the juxtaposed direction X. This configuration prevents the pair of registration rollers 29 from interfering with the movement of the process frame 19.

(11) As shown in FIG. 1, the grip portion 98 is provided on the downstream end of the transfer unit 17 with respect to the removal direction Y.

Since the user grips the grip portion 98 to move the transfer unit 17 between the mounted position and the removed position, as shown in FIG. 8, this arrangement can ensure smooth mounting and removal operations of the transfer unit 17 relative to the main casing 2.

(12) As shown in FIG. 1, the printer 1 according to the first embodiment is provided with the fixing unit 18 for fixing toner images onto the sheets P after the toner images have been transferred from the plurality of photosensitive drums 21. Thus, toner images transferred from the plurality of photosensitive drums 21 onto the sheets P are reliably fixed to the sheets P with heat in the fixing unit 18.

Further, the reversing path 40 is formed on the opposite side of the photosensitive drums 21 relative to the transfer unit 17 when the transfer unit 17 is in its mounted position.

After a toner image has been fixed to the first surface of the sheet P, the discharge rollers 38 are driven in a reverse rotation prior to discharging the sheet P onto the discharge tray 39 in order to introduce the sheet P onto the reversing path 40. Subsequently, the sheet P is conveyed along the reversing path 40 to the pair of registration rollers 29, after which the pair of registration rollers 29 again conveys the sheet P between the plurality of photosensitive drums 21 and the conveying belt 33 with the second surface of the sheet P facing upward. In this way, images can be formed on both first and second surfaces of the sheet P.

(13) As shown in FIG. 1, the reversing path 40 is positioned adjacent to the conveying belt 33 when the transfer unit 17 is in its mounted position.

Accordingly, the reversing path 40 and the transfer unit 17 can be more efficiently arranged than when other components are provided between the reversing path 40 and the conveying belt 33.

This configuration allows the printer 1, which can form images on both the first and second surfaces of the sheets P, to be made more compact.

(14) As shown in FIG. 8, the transfer unit 17 is provided with the transfer frame 41 at a position confronting the conveying belt 33 for covering the conveying belt 33. This transfer frame 41 can prevent the conveying belt 33 from coming into contact with external components when the transfer unit 17 is moved between the mounted position and the removed position or placed outside the main casing 2 (removed position). Therefore, the transfer frame 41 can prevent the conveying belt 33 from being damaged.

Further, the bottom wall of the transfer frame 41 serves as the top wall defining the reversing path 40 in the front portion thereof when the transfer unit 17 is in its mounted position shown in FIG. 1. This configuration reliably positions the reversing path 40 adjacent to the conveying belt 33 to achieve a more efficient arrangement of the reversing path 40 and the transfer unit 17.

Further, since the transfer unit 17 is provided with both the top wall of the reversing path 40 and the pair of registration rollers 29, the sheets P can be more smoothly conveyed from the reversing path 40 to the pair of registration rollers 29.

Further, since the front portion of the reversing path 40 is open on the top side when the transfer unit 17 is disposed in its removed position, as shown in FIG. 8, the user can easily remove the sheets P from the reversing path 40 through the open region 100 when the sheets P become jammed in the reversing path 40.

8. Variations of First Embodiment

In the first embodiment described above, the grip portion 98 is provided at the front end portion of the transfer unit 17.

Figure 9:
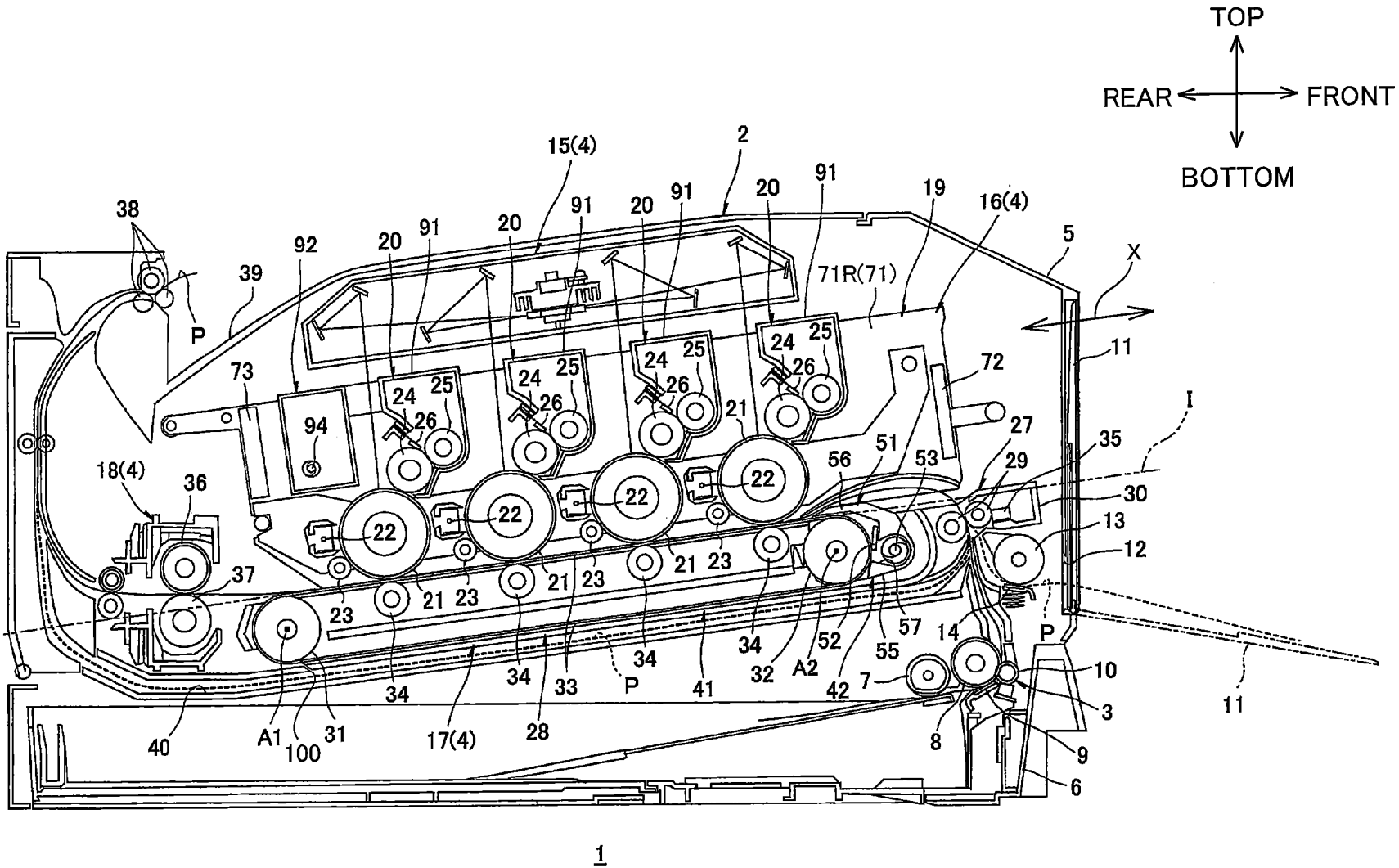
FIG. 9 is a schematic center cross-sectional view of a printer according to a variation of the first embodiment of the present invention.
Figure 10A:
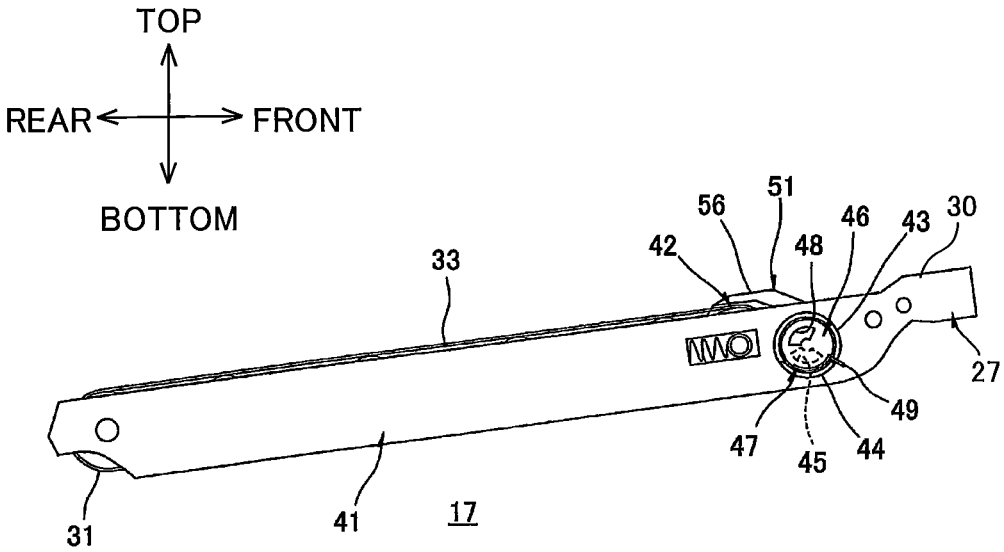
FIG. 10A is a left side view of a transfer unit shown in FIG. 9, showing a state where a frame-side shutter is in a closed position.
Figure 10B:
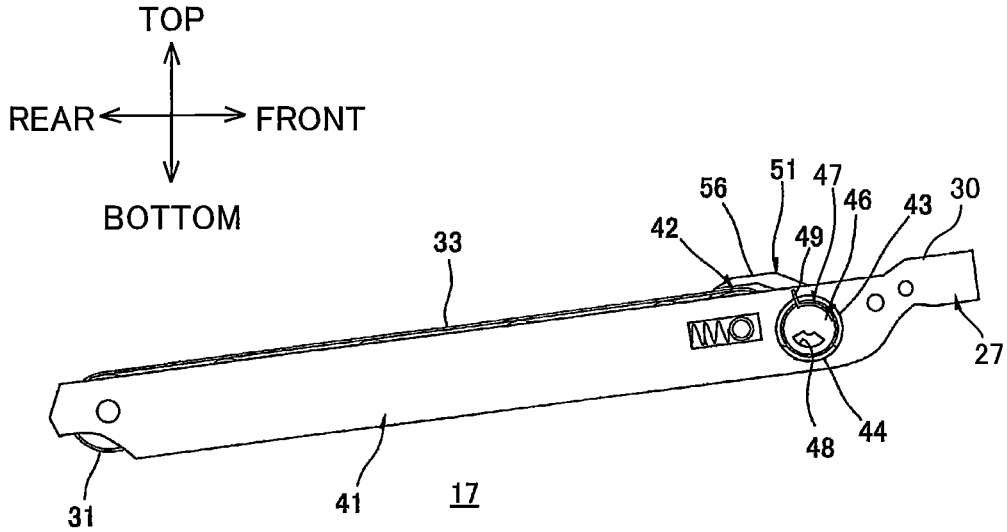
FIG. 10B is a left side view of the transfer unit shown in FIG. 9, showing a state where the frame-side shutter is in an open position.

In a variation of the first embodiment shown in FIGS. 9, 10A, 10B, the grip portion 98 may be dispensed with.

The variation of the first embodiment can obtain the same operational advantages described for the first embodiment.

9. Second Embodiment

A printer 101 as an image forming apparatus according to a second embodiment of the present invention will be described while referring to FIGS. 11 to 17, wherein like parts and components are designated with the same reference numerals to avoid duplicating description. In the following description, only parts differing from those of the embodiment will be described in detail.

(1) Overview of Second Embodiment

In the first embodiment described above, the process unit 16 is disposed in an inclined orientation inside the main casing 2 such that the front end portion of the process unit 16 is higher than the rear end portion of the process unit 16. Further, extraneous matter removed by the belt cleaner 42, which is provided at the front end portion of the transfer unit 17, is conveyed to the accommodating portion 92, which is provided at the rearmost developer cartridge 20.

In the second embodiment, a process unit 103 is disposed in an inclined orientation in the main casing 2 such that its rear end portion is higher than its front end portion. Further, extraneous matter removed by a belt-cleaning roller 108, which is provided at a rear end portion of a transfer unit 104, is conveyed to an accommodating portion 132 provided at a frontmost developer cartridge 122.

(2) Detailed Description of Transfer Unit

Figure 11:
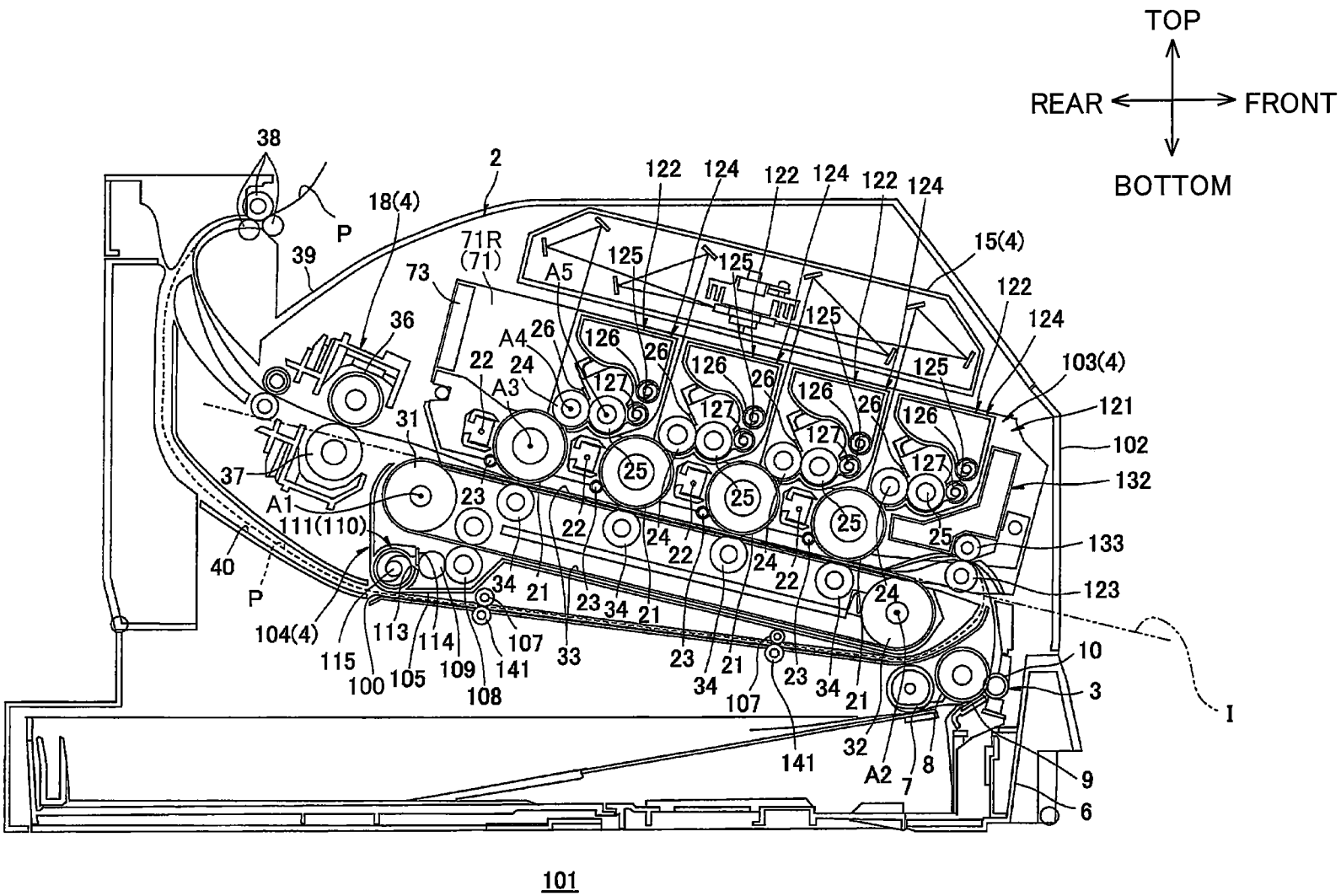
FIG. 11 is a schematic center cross-sectional view of a printer according to a second embodiment of the present invention.

As shown in FIG. 11, the transfer unit 104 is disposed in an inclined orientation in the main casing 2 such that the drive roller 31 is higher than the follow roller 32.

Figure 17:
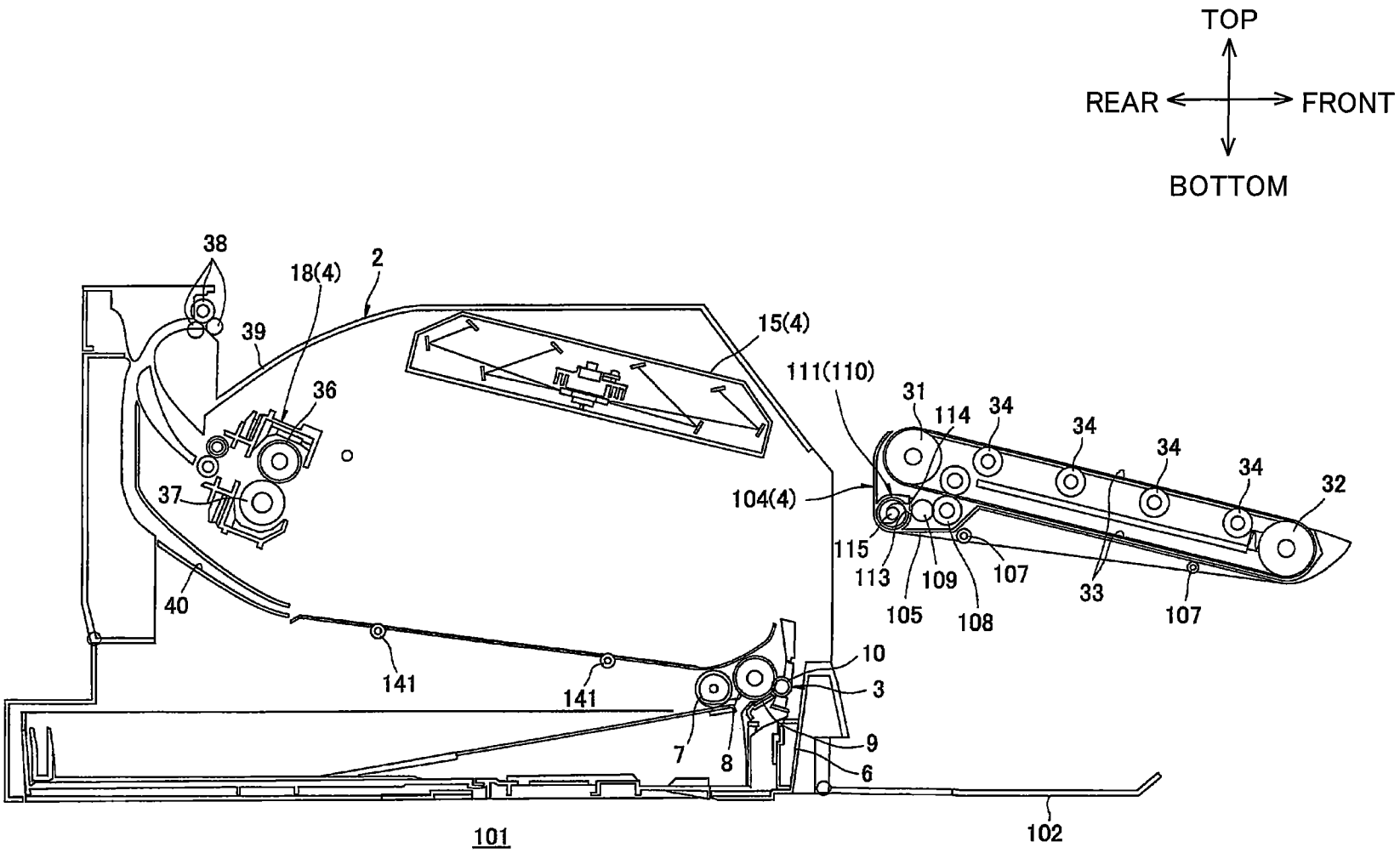
FIG. 17 is an explanatory diagram for performing maintenance operations on the transfer unit, in which both the process unit and the transfer unit have been removed from a main casing.

The transfer unit 104 is movable relative to the main casing 2 between a mounted position (see FIG. 11) and a removed position (see FIG. 17). In the mounted position, the transfer unit 104 is mounted in the main casing 2. In the removed position, the transfer unit 104 has been removed from the main casing 2.

When the drive roller 31 is driven to rotate, the conveying belt 33 circulates so that its upper portion moves along an upward slope toward the rear (i.e. from the lower front side to the upper rear side).

Figure 12:
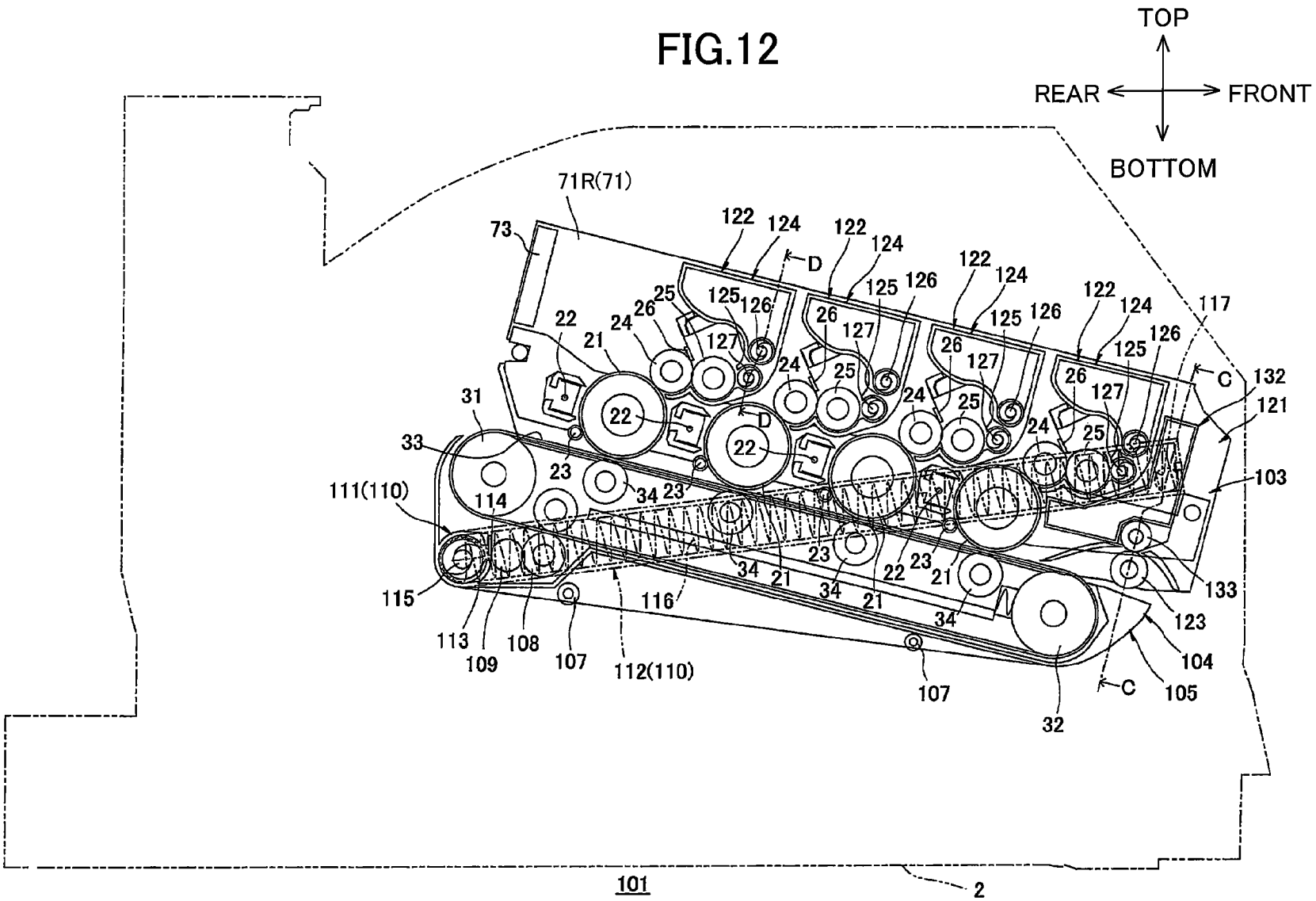
FIG. 12 is an explanatory diagram for conveyance of deposited matter from a belt-cleaning roller shown in FIG. 11 to an accommodating portion.
Figure 13:
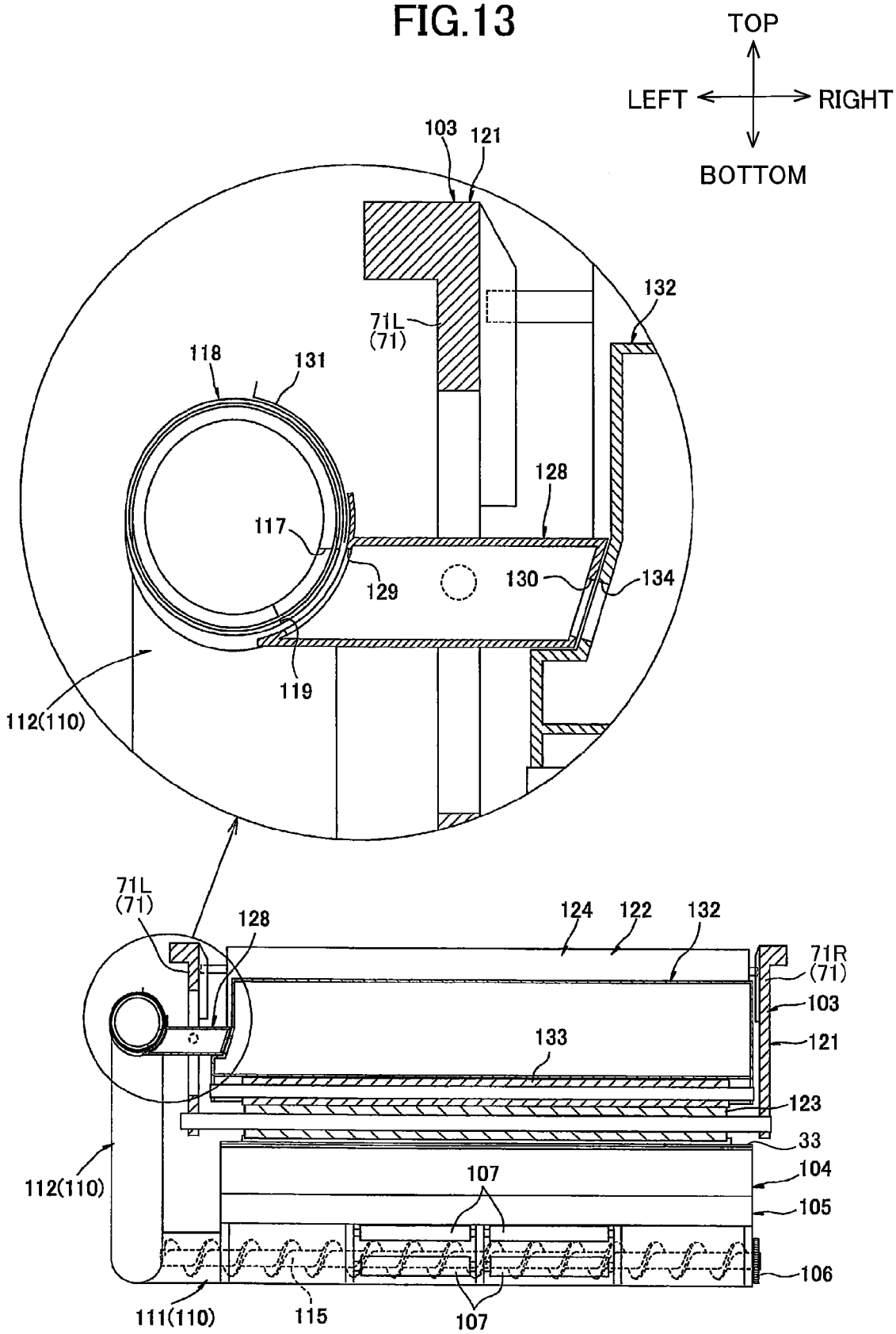
FIG. 13 is a cross-sectional view of the process unit and the transfer unit shown in FIG. 12 taken along a line C-C, showing a state where a conveying tube and the accommodating portion are coupled together.

As shown in FIGS. 12 and 13, the transfer unit 104 includes a transfer frame 105.

The transfer frame 105 has a frame-like configuration with a closed bottom and an open top. The transfer frame 105 includes the belt-cleaning roller 108, a relay roller 109, a conveying tube 110, and a plurality of sheet-conveying rollers 107.

The belt-cleaning roller 108 is disposed at a position obliquely downward and forward of the drive roller 31 and contacts the lower portion of the conveying belt 33 from below. Thus, the belt-cleaning roller 108 is positioned in proximity to the lower rear side of the rearmost photosensitive drum 21. Further, the belt-cleaning roller 108 is positioned lower than the imaginary plane I containing the top surface of the upper portion of the conveying belt 33.

The relay roller 109 is disposed on the rear side of the belt-cleaning roller 108 and contacts the belt-cleaning roller 108 from the rear.

The conveying tube 110 includes a first conveying portion 111, and a second conveying portion 112.

The first conveying portion 111 is disposed on the rear side of the relay roller 109. The first conveying portion 111 has a generally cylindrical shape and is elongated in the left-right direction. The first conveying portion 111 has a left end portion protruding leftward from a left wall of the transfer frame 105. The first conveying portion 111 includes a recovery hole 113, a scraping blade 114, and a first screw 115.

The recovery hole 113 extends approximately linearly in the left-right direction and penetrates a front circumferential wall of the first conveying portion 111.

The scraping blade 114 is provided at a front edge of a top portion of the first conveying portion 111. The scraping blade 114 has a generally flat plate shape and is elongated in the left-right direction with substantial thickness in the front-rear direction. The scraping blade 114 has an upper half portion fixed to a top peripheral edge of the first conveying portion 111 defining the recovery hole 113 and a lower half portion confronting an upper half portion of the recovery hole 113.

The first screw 115 is a left-handed auger screw extending in the left-right direction. The first screw 115 is disposed inside the first conveying portion 111.

The first screw 115 has a right end portion that is rotatably supported at a right wall of the first conveying portion 111. The first screw 115 includes a first-screw drive gear 106.

The first-screw drive gear 106 is supported at the right end portion of the first screw 115 on the right side of the first conveying portion 111 and is non-rotatable relative to the first screw 115. A drive force is inputted into the first-screw drive gear 106 from the main casing 2 through a gear train (not shown).

The second conveying portion 112 has a generally cylindrical shape that extends continuously forward from a left end portion of the first conveying portion 111. The second conveying portion 112 includes a second screw 116, a supply hole 117, and a conveying-tube-side shutter 118.

The second screw 116 has a helical configuration and extends in the front-rear direction. The second screw 116 is disposed inside the second conveying portion 112. The second screw 116 has a rear end portion that is formed continuously with the left end portion of the first screw 115 and a front end portion that is rotatably supported at a front end portion of the second conveying portion 112.

The supply hole 117 has a generally circular shape in a side view (see FIG. 12). The supply hole 117 is formed so as to penetrate a lower right peripheral wall of the second conveying portion 112 at a front end portion thereof.

The conveying-tube-side shutter 118 has a generally cylindrical shape. The conveying-tube-side shutter 118 is angularly rotatably fitted around the front end portion of the second conveying portion 112. When an intermediary conveying tube 128 described later is in a coupled position, the conveying-tube-side shutter 118 is engaged with a relay-side shutter 131 described later and rotates together with the relay-side shutter 131. An opening 119 is formed in the conveying-tube-side shutter 118.

The opening 119 has a generally circular shape in a side view. The opening 119 is formed so as to penetrate a peripheral wall of the conveying-tube-side shutter 118. When the conveying-tube-side shutter 118 is in an open position described later, the opening 119 is positioned on the lower right side of the conveying-tube-side shutter 118, confronting the supply hole 117.

Figure 14:
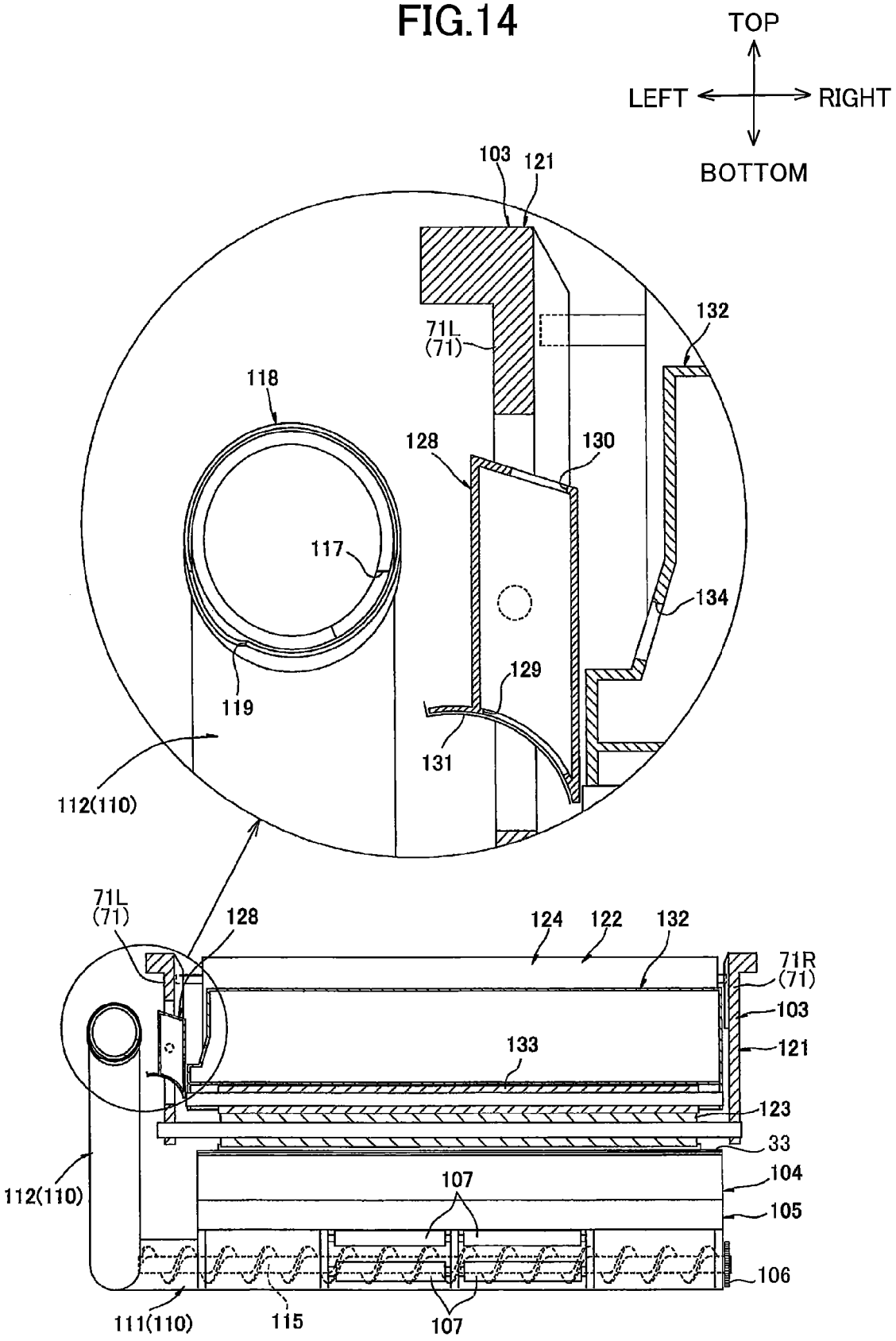
FIG. 14 is a cross-sectional view of the process unit and the transfer unit shown in FIG. 12 taken along the line C-C, showing a state where the conveying tube and the accommodating portion are uncoupled.

The conveying-tube-side shutter 118 is angularly rotatably movable between an open position (see FIG. 13) and a closed position (see FIG. 14). In the open position, the opening 119 of the conveying-tube-side shutter 118 is aligned with the supply hole 117 of the second conveying portion 112. In the closed position, the opening 119 is disposed obliquely below and leftward of the supply hole 117 so as not to be aligned with the supply hole 117.

The plurality of sheet-conveying rollers 107 is rotatably supported at a lower end portion of the transfer frame 105. Each of the plurality of sheet-conveying rollers 107 is disposed at a position confronting the top of corresponding main-casing-side paper-conveying roller 141 provided at a lower wall defining the reversing path 40.

(3) Detailed Description of Process Unit

The process unit 103 is inclined relative to the horizontal so that its front end is positioned lower than its rear end.

The process unit 103 includes a process frame 121 and a plurality of developer cartridges 122 (four in the embodiment).

As shown in FIGS. 12 and 13, the process frame 121 has a frame-like structure that is generally rectangular in a plan view. The process frame 121 includes the pair of side walls 71, and the rear beam 73.

Figure 16:
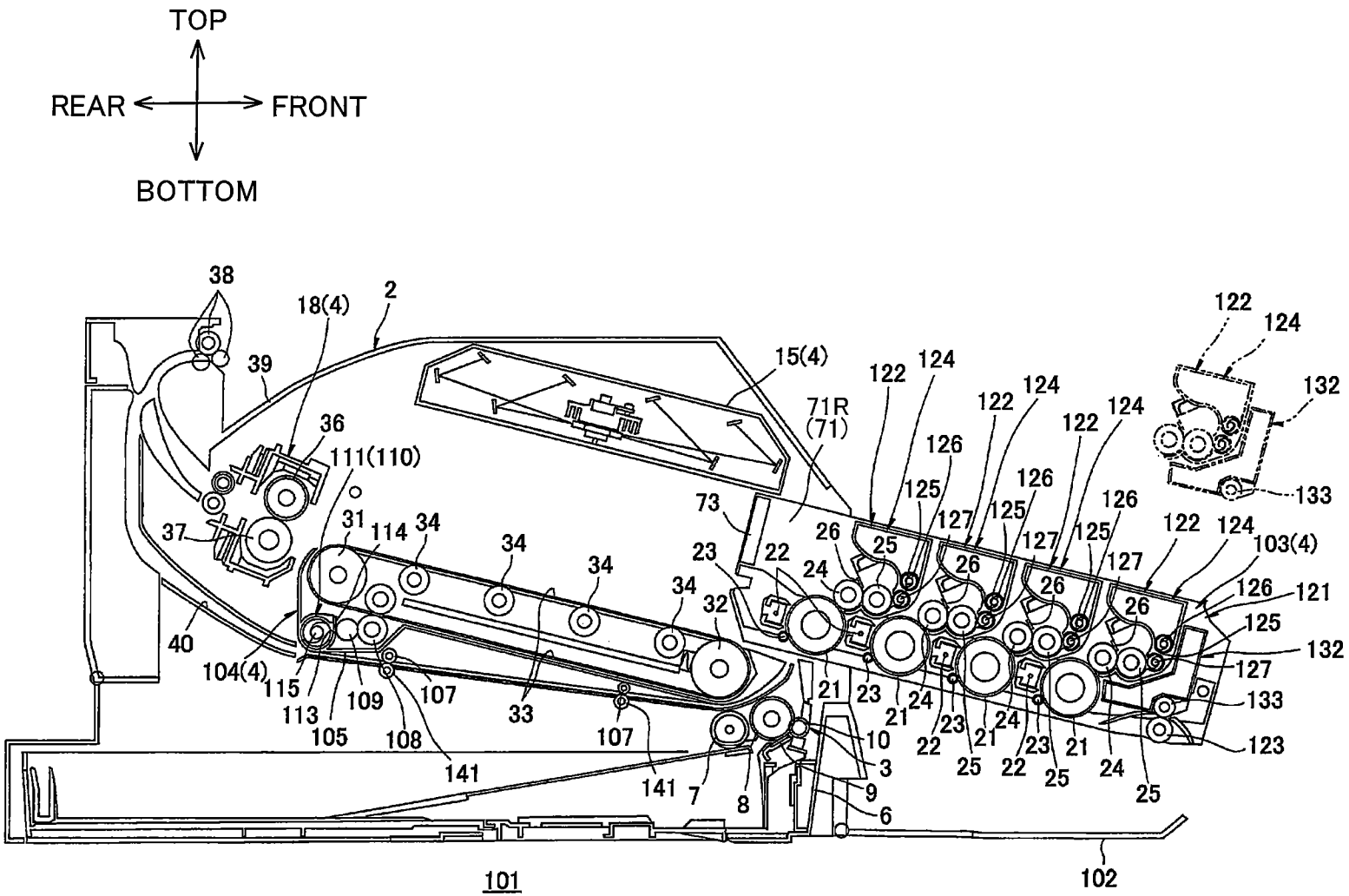
FIG. 16 is an explanatory diagram for performing maintenance operations on a developer cartridge, in which the process unit is in a withdrawn position.

The process frame 121 can move relative to the main casing 2 in the front-rear direction between an accommodated position (see FIG. 11) and a withdrawn position (see FIG. 16). In the accommodated position, the process frame 121 is accommodated inside the main casing 2. In the withdrawn position, the process frame 121 is withdrawn to an outside of the main casing 2. The process frame 121 can be removed from the main casing 2 in the withdrawn position.

The pair of side walls 71 is each generally rectangular in a side view (see FIG. 2) and elongated in the front-rear direction. The pair of side walls 71 is arranged parallel to each other and separated in the left-right direction.

The plurality of photosensitive drums 21 is arranged juxtaposed with each other and spaced at intervals along a direction sloping upward toward the rear. The plurality of photosensitive drums 21 is provided for the four colors of black, yellow, magenta, and cyan and is arranged at intervals in this order from the lower front side to the upper rear side of the main casing 2. Each photosensitive drum 21 is generally cylindrical in shape and is elongated in the left-right direction. Each photosensitive drum 21 is capable of rotating about a center axis A3 extending in the left-right direction.

Incidentally, although not illustrated in FIG. 1, the photosensitive drum 21 in the first embodiment inherently has the center axis A3.

The plurality of scorotron chargers 22 is positioned on the upper rear side of the corresponding photosensitive drum 21. The plurality of drum-cleaning rollers 23 is positioned so as to contact the photosensitive drum 21 from the rear side thereof.

The process frame 121 includes a registration roller 123, and the intermediary conveying tube 128.

The registration roller 123 is supported at the process frame 121 at a position between the pair of side walls 71. More specifically, the registration roller 123 is rotatably supported at lower front end portions of the side walls 71.

The intermediary conveying tube 128 is provided at the left side wall 71L constituting the process frame 121 at a front end portion thereof. The intermediary conveying tube 128 has a generally cylindrical shape that is closed on both left and right ends thereof and is elongated in the left-right direction when in the coupled position described later. The intermediary conveying tube 128 (in the coupled position shown in FIG. 13) has a left wall that is formed in a curve that conforms to a circumferential surface of the second conveying portion 112 of the conveying tube 110. The intermediary conveying tube 128 includes a receiving hole 129, a discharge hole 130, and the relay-side shutter 131.

The receiving hole 129 penetrates the left wall of the intermediary conveying tube 128 and confronts the opening 119 of the conveying-tube-side shutter 118 when the intermediary conveying tube 128 is in the coupled position.

The discharge hole 130 penetrates a right wall of the intermediary conveying tube 128 and confronts an accommodating hole 134 formed in the accommodating portion 132 described later when the intermediary conveying tube 128 is in the coupled position.

The relay-side shutter 131 is disposed on the left side of the left wall of the intermediary conveying tube 128. The relay-side shutter 131 has a generally flat plate shape that is curved to conform to the curved left wall of the intermediary conveying tube 128. The relay-side shutter 131 is vertically slidingly movable between an open position (see FIG. 13) and a closed position (see FIG. 14). In the open position, the relay-side shutter 131 is disposed above the receiving hole 129. In the closed position, the relay-side shutter 131 confronts the receiving hole 129 from the left side thereof.

The intermediary conveying tube 128 is pivotally movable about its center between a coupled position (see FIG. 13) and an uncoupled position (see FIG. 14). In the coupled position, the intermediary conveying tube 128 extends in the left-right direction. In the uncoupled position, the intermediary conveying tube 128 extends vertically. When the intermediary conveying tube 128 is in the uncoupled position, the receiving hole 129 is separated from and moved below the opening 119 of the conveying-tube-side shutter 118, and the discharge hole 130 is separated from and moved above the accommodating hole 134 of the accommodating portion 132 described later.

The rear beam 73 bridges the rear end portions of the pair of side walls 71. The rear beam 73 has a generally flat plate shape and is elongated in the left-right direction, with substantial thickness in the front-rear direction.

As described above and as shown in FIGS. 12 and 15, each developer cartridge 122 includes the developing roller 24, the supply roller 25, and the thickness-regulating blade 26. The developing roller 24 is rotatably supported at a lower end portion of the developer cartridge 122 and is exposed in the lower rear side of the developer cartridge 122. The developing roller 24 contacts the photosensitive drum 21 from the upper front side thereof.

The developing roller 24 has a generally cylindrical shape and is elongated in the left-right direction. The developing roller 24 is capable of rotating about a center axis A4 extending in the left-right direction. The center axis A4 of the developing roller 24 is parallel to the center axis A3 of the photosensitive drum 21 and occupies a position obliquely above and forward of the center axis A3 of the photosensitive drum 21.

Incidentally, although not illustrated in FIG. 1, the developing roller 24 in the first embodiment inherently has the center axis A4.

The supply roller 25 is disposed slightly obliquely below and forward of the developing roller 24 and contacts the developing roller 24 from the lower front side thereof.

The supply roller 25 has a generally cylindrical shape and is elongated in the left-right direction. The supply roller 25 is capable of rotating about a center axis A5 extending in the left-right direction. The center axis A5 of the supply roller 25 is parallel to the center axis A3 of the photosensitive drum 21 and occupies a position forward of and slightly lower than the center axis A4 of the developing roller 24.

Incidentally, although not illustrated in FIG. 1, the supply roller 25 in the first embodiment inherently has the center axis A5.

Figure 15:
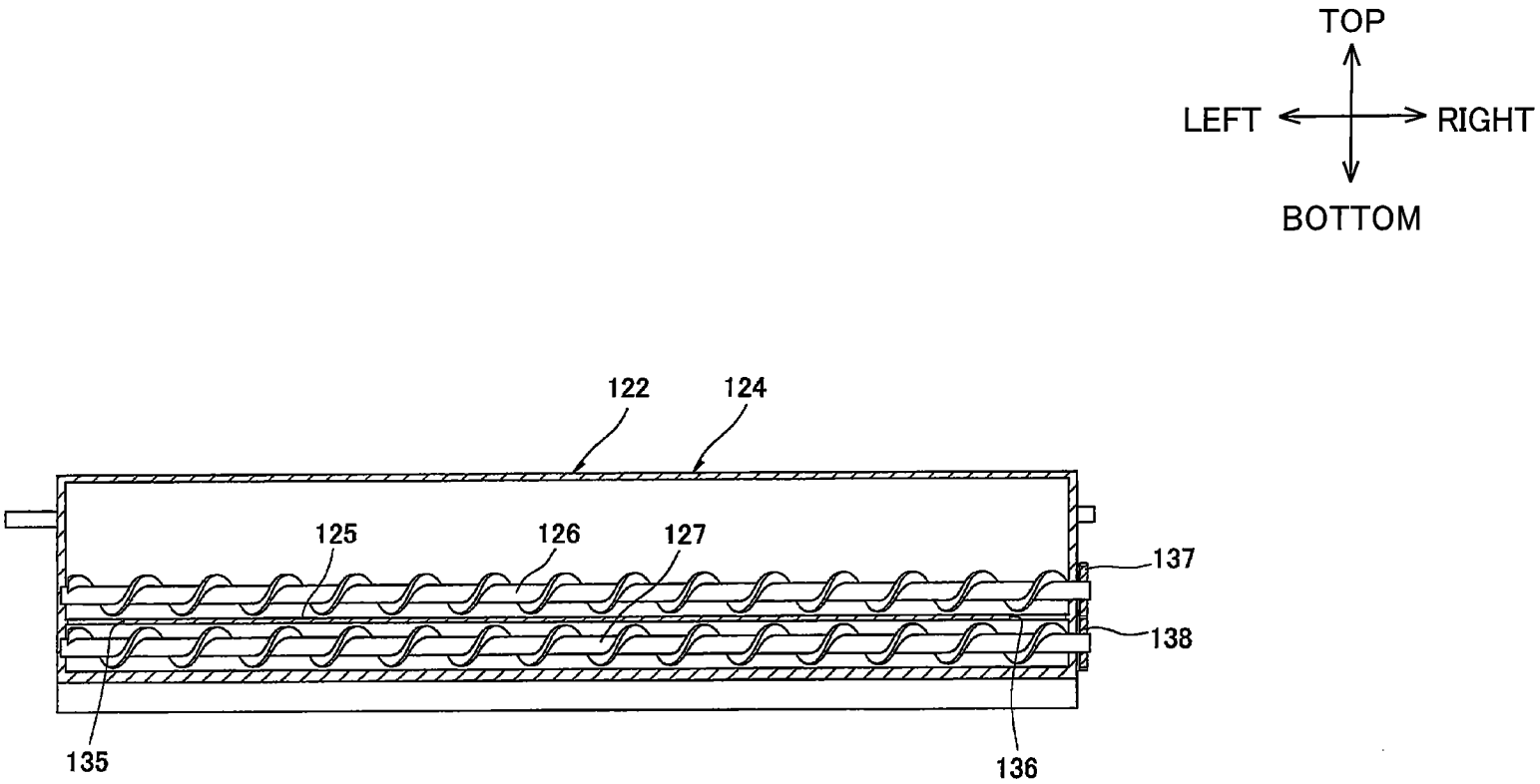
FIG. 15 is a cross-sectional view of the process unit and the transfer unit shown in FIG. 12 taken along a line D-D.

As shown in FIGS. 11 and 15, the developer cartridge 122 also includes a toner-accommodating chamber 124 for accommodating toner therein.

The toner-accommodating chamber 124 is disposed obliquely above and forward of the supply roller 25. The toner-accommodating chamber 124 has a box-like shape that is elongated in the left-right direction. The toner-accommodating chamber 124 has a front end portion protruding downward.

Toner in each of the toner-accommodating chambers 124 is supplied onto the corresponding supply roller 25, and the rotating supply roller 25 supplies the toner onto the corresponding developing roller 24 while the toner is tribocharged between the supply roller 25 and developing roller 24.

The toner-accommodating chamber 124 includes a partitioning wall 125, a toner supply screw 126, and a toner recovery screw 127.

The partitioning wall 125 is disposed in a lower front portion of the toner-accommodating chamber 124. The partitioning wall 125 has a generally flat plate shape and is elongated in the front-rear direction. The partitioning wall 125 divides the lower front portion of the toner-accommodating chamber 124 vertically. Within the partitioning wall 125 are formed a toner supply hole 135, and a toner recovery hole 136 (see FIG. 15).

The toner supply hole 135 is formed so as to penetrate a left end portion of the partitioning wall 125.

The toner recovery hole 136 is formed so as to penetrate a right end portion of the partitioning wall 125.

The toner supply screw 126 is disposed inside the toner-accommodating chamber 124 above the partitioning wall 125. The toner supply screw 126 is a left-handed auger screw that extends in the left-right direction. The toner supply screw 126 has left and right end portions that are rotatably supported at respective left and right walls of the toner-accommodating chamber 124. The toner supply screw 126 includes a drive gear 137.

The drive gear 137 is supported at the right end portion of the toner supply screw 126 on the right side of the toner-accommodating chamber 124 and is non-rotatable relative to the toner supply screw 126. A drive force is inputted into the drive gear 137 from the main casing 2 through a gear train (not shown).

The toner recovery screw 127 is disposed inside the toner-accommodating chamber 124 below the partitioning wall 125. The toner recovery screw 127 is a left-handed auger screw that extends in the left-right direction. The toner recovery screw 127 has left and right end portions that are rotatably supported at the respective left and right walls of the toner-accommodating chamber 124. The toner recovery screw 127 has a drive gear 138.

The drive gear 138 is supported at the right end portion of the toner recovery screw 127 on the right side of the toner-accommodating chamber 124 and is non-rotatable relative to the toner recovery screw 127. The drive gear 138 engages with the drive gear 137 provided at the toner supply screw 126 from below.

The toner supply screw 126 conveys toner from right to left in the toner-accommodating chamber 124 and supplies the toner through the toner supply hole 135 to the left end portion of the toner recovery screw 127. The toner recovery screw 127 conveys the toner supplied onto its left end portion toward the right side and supplies the toner onto the supply roller 25. The toner recovery screw 127 subsequently conveys any excess toner not carried on the surface of the supply roller 25 rightward and supplies this toner through the toner recovery hole 136 onto the right end portion of the toner supply screw 126.

As shown in FIGS. 12 and 13, the frontmost developer cartridge 122 also includes the accommodating portion 132, and an opposing roller 133.

The accommodating portion 132 is integrally disposed on the front side of the toner-accommodating chamber 124 provided in the frontmost developer cartridge 122. That is, the accommodating portion 132 is disposed adjacent to an upper front portion of the frontmost photosensitive drum 21. The accommodating portion 132 is also positioned above the imaginary plane I containing the top surface of the upper portion of the conveying belt 33. The accommodating portion 132 has a box-like shape that has a generally L-shaped cross-section. The accommodating hole 134 is formed in the accommodating portion 132.

The accommodating hole 134 is formed so as to penetrate a left wall of the accommodating portion 132. The accommodating hole 134 has a generally circular shape in a side view.

The opposing roller 133 is rotatably supported at the developer cartridge 122 below the toner-accommodating chamber 124. The opposing roller 133 contacts the registration roller 123 of the process frame 121 from above.

The sheets P accommodated in the paper tray 6 are conveyed by the feeding roller 8 one at a time toward a position between the registration roller 123 and the opposing roller 133.

(4) Recovery of Extraneous Matter

During the image-forming operation described above, a cleaning operation on the conveying belt 33 and cleaning operations on the respective photosensitive drums 21 are executed. Next, these cleaning operations will be described with reference to FIGS. 12 and 13.

When the image-forming operation described above is executed in the printer 101, a cleaning bias is applied to the drum-cleaning rollers 23. Through this cleaning bias, residual toner, paper dust, and other extraneous matter deposited on the surfaces of the photosensitive drums 21 are attracted to and temporarily retained on circumferential surfaces of the corresponding drum-cleaning rollers 23 as the extraneous matter rotates opposite the drum-cleaning rollers 23.

Extraneous matter deposited on the surface of the conveying belt 33 circulates together with the conveying belt 33 until reaching an area of contact between the conveying belt 33 and the belt-cleaning roller 108. At this time, the extraneous matter is attracted to and retained on the belt-cleaning roller 108 by static electricity. The extraneous matter is subsequently passed to the relay roller 109, where it is scraped off the relay roller 109 by the scraping blade 114 and collected in the first conveying portion 111 through the recovery hole 113.

The rotating first screw 115 subsequently conveys the extraneous matter collected in the first conveying portion 111 leftward toward a left end portion of the first conveying portion 111. Then, the rotating second screw 116 conveys the extraneous matter forward from a rear end portion of the second conveying portion 112. The extraneous matter sequentially passes through the supply hole 117 of the second conveying portion 112, the opening 119 of the conveying-tube-side shutter 118, and the receiving hole 129 of the intermediary conveying tube 128, and is introduced into a left end portion of the intermediary conveying tube 128.

The extraneous matter introduced into the left end portion of the intermediary conveying tube 128 sequentially passes through the intermediary conveying tube 128 and through the discharge hole 130 of the intermediary conveying tube 128 and the accommodating hole 134 of the accommodating portion 132 to be collected in the accommodating portion 132.

The cleaning operation on the conveying belt 33 is completed after the extraneous matter deposited on the surface of the conveying belt 33 is recovered in the accommodating portion 132.

Once the image-forming operation described above has completed, the drum-cleaning bias is controlled so that the extraneous matter temporarily retained on the drum-cleaning rollers 23 is expelled back onto the corresponding photosensitive drums 21.

As the photosensitive drums 21 rotate, the extraneous matter returned to the photosensitive drums 21 rotates toward the conveying belt 33 and is thereby expelled onto the conveying belt 33.

The extraneous matter expelled onto the conveying belt 33 is subsequently recovered by the belt-cleaning roller 108 as the conveying belt 33 circulates, as described above, and is conveyed to the accommodating portion 132 through the conveying tube 110.

The cleaning operations on the photosensitive drums 21 are completed after the extraneous matter deposited on the surfaces of the photosensitive drums 21 is collected in the accommodating portion 132, as described above.

(5) Maintenance on Developer Cartridges

To perform maintenance on a developer cartridge 122, the user initially pulls the process unit 103 out to the withdrawn position.

More specifically, first the user opens a front cover 102 on the main casing 2, as shown in FIG. 16.

Next, the user slides the relay-side shutter 131 clockwise in a front view from its open position toward its closed position, as shown in FIGS. 13 and 14. Through this operation, both the relay-side shutter 131 and the conveying-tube-side shutter 118 are in their closed positions, blocking the receiving hole 129 of the intermediary conveying tube 128 and the supply hole 117 of the second conveying portion 112.

Next, the user pivotally moves the intermediary conveying tube 128 counterclockwise in a front view into its uncoupled position. At this time, the relay-side shutter 131 is disengaged from the conveying-tube-side shutter 118.

Subsequently, the user pulls the process unit 103 forward, as shown in FIG. 16.

In order to perform maintenance on the developer cartridge 122, the user pulls the developer cartridge 122 upward until the developer cartridge 122 separates from the process unit 103. When pulling the frontmost developer cartridge 122, the accommodating portion 132 separates from the process unit 103 together with the frontmost developer cartridge 122.

This completes the operation to remove the developer cartridge 122 from the main casing 2.

Thereafter, the user can perform maintenance on the developer cartridge 122.

The developer cartridge 122 is mounted in the main casing 2 by performing the operation to remove the developer cartridge 122 described above in reverse.

That is, when mounting the developer cartridge 122 in the main casing 2, the user first positions the developer cartridge 122 above the process unit 103 and inserts the developer cartridge 122 downward into the process unit 103 until the developer cartridge 122 is mounted therein.

Next, the user pushes the process unit 103 rearward into the main casing 2.

Next, the user pivotally moves the intermediary conveying tube 128 clockwise in a front view until the intermediary conveying tube 128 is in its coupled position, as shown in FIGS. 13 and 14. At this time, the relay-side shutter 131 and the conveying-tube-side shutter 118 are engaged with each other.

Subsequently, the user slides the relay-side shutter 131 counterclockwise in a front view from its closed position toward its open position. Through this operation, both the relay-side shutter 131 and the conveying-tube-side shutter 118 are in their open positions so as to uncover the receiving hole 129 of the intermediary conveying tube 128 and the supply hole 117 of the second conveying portion 112.

Lastly, the user closes the front cover 102 on the main casing 2. This completes the operation to mount the developer cartridges 122 in the main casing 2.

(6) Maintenance on Transfer Unit and Paper Jam Resolution

To perform maintenance on the transfer unit 104 or to remove the sheet P that has become jammed in the reversing path 40, the user first pulls the process unit 103 out to the withdrawn position, as described above, and removes the process unit 103 from the main casing 2.

Thereafter, the user removes the transfer unit 104 from the main casing 2, as shown in FIG. 17, and performs maintenance on the transfer unit 104 or clears the jammer sheet P from the reversing path 40. Note that the conveying tube 110 is removed together with the transfer unit 104 at this time.

(7) Operational Advantages of Second Embodiment (7-1) In the printer 101 according to the second embodiment, the belt-cleaning roller 108 is disposed near the rearmost photosensitive drum 21, which is the developer cartridge 122 closest to the drive roller 31, and the drive roller 31 is positioned higher than the follow roller 32, as shown in FIG. 12. The extraneous matter removed by the belt-cleaning roller 108 can be conveyed to the accommodating portion 132 positioned near the frontmost photosensitive drum 21, which is the photosensitive drum 21 closest to the follow roller 32.

This configuration shortens the vertical distance between the belt-cleaning roller 108 and the accommodating portion 132 by the vertical difference between the drive roller 31 and the follow roller 32.

Thus, the slope of the second conveying portion 112 relative to a horizontal plane can be made smaller than the angle of repose of the toner, making it easier to convey extraneous matter removed by the belt-cleaning roller 108 to the accommodating portion 132. In other words, this configuration facilitates the use of toner having greater fluidity for achieving higher quality images.

(7-2) In the printer 101 according to the second embodiment, as shown in FIGS. 14 and 17, the conveying tube 110 (i.e., the first conveying portion 111 and the second conveying portion 112) can be mounted and removed together with the transfer unit 104.

Hence, this configuration enables more efficient maintenance of the conveying tube 110 since this maintenance can be performed at the same time as maintenance on the transfer unit 104.

(7-3) In the printer 101 according to the second embodiment, as shown in FIG. 11, the follow roller 32 is disposed on the front end portion of the transfer unit 104, and specifically the downstream end portion thereof with respect to the direction in which the process unit 103 is pulled out of the main casing 2.

Accordingly, the front end portion of the process unit 103 can be positioned lower than its rear end portion.

Thus, when removing the process unit 103 from the main casing 2, the weight of the process unit 103 can be utilized to facilitate the withdrawal motion.

In the printer 101 according to the second embodiment, as shown in FIGS. 13 and 14, the accommodating portion 132 and the conveying tube 110 are coupled or uncoupled through the intermediary conveying tube 128 provided at the front end portion of the process unit 103.

This arrangement facilitates operations for coupling and uncoupling the accommodating portion 132 and the conveying tube 110 since the relay-side shutter 131 can be operated from the front side of the printer 1.

(7-4) In the printer 101 according to the second embodiment, as shown in FIG. 11, the center axis A5 of the supply roller 25 is lower than the center axis A4 of the developing roller 24. Thus, the supply roller 25 confronts the peripheral surface of the developing roller 24 on the lower side thereof.

This arrangement reduces the likelihood of toner being excessively supplied from the supply roller 25 to the developing roller 24 due to gravity.

As a result, this configuration suppresses accumulation of toner about the developing roller 24, reducing the likelihood that toner will leak around the developing roller 24.

Further, the photosensitive drums 21 provided closer to the front side are lower than the photosensitive drums 21 provided relatively rearward.

Further, the developing rollers 24 are provided on the front sides of the corresponding photosensitive drums 21, and the supply rollers 25 are provided on the front sides of the corresponding developing rollers 24.

In this way, the developing roller 24 and the supply roller 25 corresponding to the photosensitive drum 21 disposed to the rear side thereof can be efficiently arranged in the space above the photosensitive drum 21 disposed to the front side thereof.

Thus, this configuration can reduce the gap between adjacent photosensitive drums 21 more than a structure that arranges the developing roller 24 and the supply roller 25 between adjacent photosensitive drums 21.

Hence, this arrangement prevents the printer 101 from becoming larger.

(7-5) In the printer 101 according to the second embodiment, as shown in FIG. 11, each of the developing rollers 24 contacts the corresponding photosensitive drum 21 such that the center axis A4 of the developing roller 24 is higher than the center axis A3 of the photosensitive drum 21.

Accordingly, the developing roller 24 and the supply roller 25 corresponding to the photosensitive drum 21 disposed to the rear side thereof can be more efficiently arranged in the space above the photosensitive drum 21 disposed to the front side thereof.

Hence, this arrangement can further reduce the gap between adjacent photosensitive drums 21, suppressing an increase in the size of the printer 101.

(7-6) In the printer 101 according to the second embodiment, as shown in FIG. 11, the toner recovery screw 127 in the toner-accommodating chamber 124 confronts the front circumferential surface of the supply roller 25.

This configuration reduces the likelihood of toner being supplied excessively to the supply roller 25 due to gravity.

Thus, this construction further reduces the accumulation of toner about the developing roller 24, thereby further suppressing leakage of toner around the developing roller 24.

(7-7) In the printer 101 according to the second embodiment, as shown in FIG. 15, the toner recovery screw 127 can convey excess toner supplied to the supply roller 25 through the toner recovery hole 136 to be recovered in the toner-accommodating chamber 124.

This configuration provides a uniform amount of toner to the supply roller 25 while suppressing an excessive amount of toner from being supplied to the supply roller 25.

Accordingly, this configuration can better suppress toner from being supplied excessively from the supply roller 25 to the developing roller 24.

As a result, this arrangement better suppresses the accumulation of toner about the developing roller 24 and, hence, better suppresses toner from leaking around the developing roller 24.

(7-8) In the printer 101 according to the second embodiment, as shown in FIG. 11, the conveying belt 33 conveys the sheets P along the plurality of photosensitive drums 21.

This configuration is that of a direct tandem-type printer in which toner images are directly transferred from the photosensitive drums 21 onto the sheet P.

(7-9) The printer 101 according to the second embodiment can obtain the same operational advantages described for the printer 1 according to the first embodiment.

(8) Variations of Second Embodiment

In the second embodiment described above, both the toner supply screw 126 and the toner recovery screw 127 of the developer cartridge 122 are configured as left-handed auger screws, further the toner supply hole 135 is formed in the left end portion of the partitioning wall 125, and the toner recovery hole 136 is formed in the right end portion of the partitioning wall 125.

Figure 18:
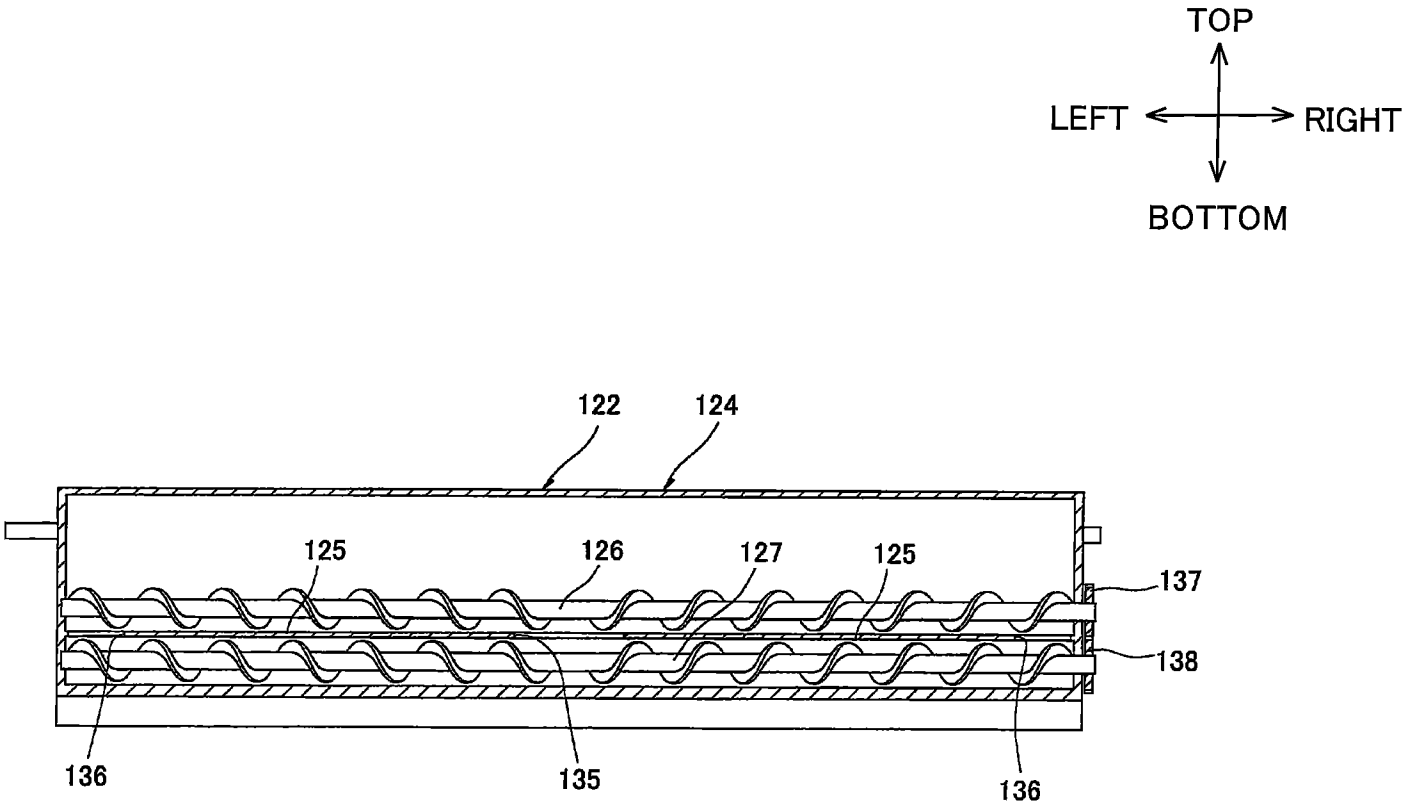
FIG. 18 is an explanatory diagram for a variation of the second embodiment.

In a variation of the second embodiment shown in FIG. 18, the right half portions of both the toner supply screw 126 and the toner recovery screw 127 are configured as left-handed auger screws, while the left half portions are configured as right-handed auger screws. Further, the toner supply hole 135 is formed in the left-right center of the partitioning wall 125, while two toner recovery holes 136 are formed respectively in the left and right end portions of the partitioning wall 125.

The variation of the second embodiment can obtain the same operational advantages described for the second embodiment.

While the present invention has been described in detail with reference to the embodiments thereof, it would be apparent to those skilled in the art that various changes and modifications may be made therein without departing from the spirit of the present invention.

What is claimed is:

1. An image forming apparatus comprising:

a casing;

a belt unit configured to be accommodated in the casing, the belt unit comprising:

a first roller having a first rotation axis;

a second roller having a second rotation axis parallel to the first rotation axis, the second roller being spaced apart from the first roller and positioned higher than the first roller; and a belt looped around the first roller and the second roller and having an upper portion;

a plurality of image bearing members each configured to bear a developer image thereon, the plurality of image bearing members being juxtaposed with each other and spaced apart from each other in an orthogonal direction that is orthogonal to the first and second rotation axes and that is oriented in a direction from the first roller to the second roller, the plurality of image bearing members each having a bottom portion contacting the upper portion of the belt, the plurality of image bearing members including a first image bearing member positioned closer to the first roller than remaining image bearing members to the first roller and a second image bearing member positioned closer to the second roller than remaining image bearing members to the second roller;

a plurality of developer containers disposed in one-to-one correspondence with the plurality of image bearing members, the plurality of developer containers each configured to accommodate developer therein and configured to be detached from and attached to the casing, the plurality of developer containers including a first developer container corresponding to the first image bearing member;

a removing member configured to remove a waste toner deposited on the belt, the removing member being positioned adjacent to the second image bearing member and below an imaginary plane containing a top surface of the upper portion of the belt;

an accommodating member configured to accommodate the waste toner removed by the removing member, the accommodating member being positioned adjacent to the first image bearing member and above the imaginary plane, the accommodating member being configured to be mounted in and removed from the casing along with the first developer container; and a conveying member configured to convey the waste toner removed by the removing member to the accommodating member.

2. The image forming apparatus as claimed in claim 1, wherein each of the plurality of image bearing members is elongated in an elongated direction, and wherein the conveying member comprises:

a first conveying member configured to convey the waste toner removed by the removing member in the elongated direction; and a second conveying member disposed on a downstream side of the belt in the elongated direction and configured to convey the waste toner conveyed by the first conveying member to the accommodating member.

3. The image forming apparatus as claimed in claim 2, wherein the belt unit is configured to be mounted in and removed from the casing, with the first conveying member and the second conveying member being integrally moved with the belt unit.

4. The image forming apparatus as claimed in claim 2, further comprising a retainer configured to retain the plurality of image bearing members and configured to move relative to the casing between an accommodated position in which the retainer is accommodated inside the casing and a withdrawn position in which the retainer is withdrawn to an outside of the casing.

5. The image forming apparatus as claimed in claim 4, wherein the retainer moves from the accommodated position to the withdrawn position in a withdrawal direction, wherein the first roller is positioned upstream of the second roller in the withdrawal direction, wherein the first conveying member is provided at the belt unit, and wherein the second conveying member is provided at the retainer.

6. The image forming apparatus as claimed in claim 4, wherein the retainer moves from the accommodated position to the withdrawn position in a withdrawal direction, wherein the first roller is positioned downstream of the second roller in the withdrawal direction, and wherein the belt unit is configured to be mounted in and removed from the casing, with the first conveying member and the second conveying member being integrally moved with the belt unit.

7. The image forming apparatus as claimed in claim 1, wherein the belt unit further comprises a pair of conveying rollers configured to convey a recording medium to a position between the plurality of image bearing members and the belt, the pair of conveying rollers being disposed in proximity to each other, the belt unit being configured to move relative to the casing between a mounted position in which the belt unit has been mounted in the casing and a removed position in which the belt unit has been removed from the casing.

8. An image forming apparatus as claimed in claim 1, wherein the plurality of image bearing members each has a third rotation axis and is configured to rotate about the third rotation axis; and wherein each of the plurality of developer containers includes a developer carrying member and a supply member, the developer carrying member being configured to carry developer thereon and contacting the corresponding image bearing member, the developer carrying member each having a fourth rotation axis parallel to the third rotation axis and configured to rotate about the fourth rotation axis, the fourth rotation axis being positioned upstream of the third rotation axis in the orthogonal direction, the supply member being configured to supply developer to the developer carrying member and contacting the developer carrying member, the supply member having a fifth rotation axis parallel to the third rotation axis and configured to rotate about the fifth rotation axis, the fifth rotation axis being positioned upstream of the fourth rotation axis in the orthogonal direction and positioned lower than the fourth rotation axis.

9. An image forming apparatus comprising:

a casing;

a belt unit configured to be accommodated in the casing, the belt unit comprising:

a first roller having a first rotation axis;

a second roller having a second rotation axis parallel to the first rotation axis, the second roller being spaced apart from the first roller and positioned higher than the first roller; and a belt looped around the first roller and the second roller and having an upper portion;

a plurality of image bearing members each configured to bear an electrostatic latent image thereon, the plurality of image bearing members being juxtaposed with each other and spaced apart from each other in an orthogonal direction that is orthogonal to the first and second rotation axes and that is oriented in a direction from the first roller to the second roller, the plurality of image bearing members each having a bottom portion contacting the upper portion of the belt, the plurality of image bearing members each having a third rotation axis and configured to rotate about the third rotation axis;

a plurality of developer carrying members disposed in one-to-one correspondence with the plurality of image bearing members, the plurality of developer carrying members each being configured to carry developer thereon and contacting the corresponding image bearing member, the plurality of developer carrying members each having a fourth rotation axis parallel to the third rotation axis and configured to rotate about the fourth rotation axis, the fourth rotation axis being positioned upstream of the third rotation axis in the orthogonal direction; and a plurality of supply members disposed in one-to one correspondence with the plurality of developer carrying members, the plurality of supply members each configured to supply developer to the corresponding developer carrying member and contacting the corresponding developer carrying member, the plurality of supply members each having a fifth rotation axis parallel to the third rotation axis and configured to rotate about the fifth rotation axis, the fifth rotation axis being positioned upstream of the fourth rotation axis in the orthogonal direction and positioned lower than the fourth rotation axis.

10. The image forming apparatus as claimed in claim 9, wherein the fourth rotation axis is positioned higher than the third rotation axis.

11. The image forming apparatus as claimed in claim 9, wherein the third rotation axis extends in an extending direction, the image forming apparatus further comprising a plurality of developer accommodating portions disposed in one-to-one correspondence with the plurality of supply members and each configured to accommodate developer therein, the plurality of developer accommodating portions each including a first conveying member positioned upstream of the corresponding supply member in the orthogonal direction and confronting the corresponding supply member, the first conveying member being configured to convey developer in the extending direction.

12. The image forming apparatus as claimed in claim 11, wherein the plurality of developer accommodating portions each further includes a partitioning wall disposed above and in confrontation with the first conveying member and a second conveying member disposed above and in confrontation with the partitioning wall, the second conveying member being configured to convey developer in the extending direction, and wherein the partitioning wall has a supply port configured to supply the developer conveyed by the second conveying member to the first conveying member, and a collection port configured to supply the developer conveyed by the first conveying member to the second conveying member.

13. The image forming apparatus as claimed in claim 9, wherein the belt is configured to convey a recording medium.

* * * * *